United States Patent [19]

Hirose et al.

[11] Patent Number: 5,063,143

[45] Date of Patent: Nov. 5, 1991

[54] PROCESS FOR FORMING COLOR IMAGE

[75] Inventors: Takeshi Hirose; Akira Abe; Kiyoshi Nakazyo, all of Minami-ashigara, Japan

[73] Assignee: Fuji Photo Film Co., Ltd., Minami-ashigara, Japan

[21] Appl. No.: 506,201

[22] Filed: Apr. 9, 1990

[30] Foreign Application Priority Data

Apr. 10, 1989 [JP] Japan ..... 1-90065

[51] Int. Cl.[5] ..... G03C 5/38

[52] U.S. Cl. ..... 430/419; 430/376; 430/385; 430/386; 430/387; 430/388; 430/389; 430/393; 430/418; 430/436; 430/456; 430/460; 430/467

[58] Field of Search ..... 430/418, 419, 436, 456, 430/460, 376, 385, 467, 389, 388, 387, 393, 386

[56] References Cited

U.S. PATENT DOCUMENTS

| | | | |
|---|---|---|---|
| 3,756,822 | 9/1973 | Sahyun | 430/419 |
| 4,146,396 | 3/1979 | Yokota et al. | 430/385 |
| 4,203,768 | 5/1980 | Inouye et al. | 430/388 |
| 4,216,285 | 8/1980 | Miller | 430/140 |
| 4,367,282 | 1/1983 | Yagihara et al. | 430/381 |

*Primary Examiner*—Charles L. Bowers, Jr.
*Assistant Examiner*—Janis L. Dote
*Attorney, Agent, or Firm*—Burns, Doane, Swecker & Mathis

[57] ABSTRACT

A process for forming a color image wherein a color photographic material is developed with a processing solution containing a solvent for the silver halide in the presence of an aromatic primary amino color devloping agent. The color photographic material comprises, on a support, at least one layer containing (1) a coupler capable of forming a dye by reaction with an oxidized aromatic primary amino color developing agent and having a dye covering power of at least 0.75 and (2) a silver chlorobromide emulsion or silver chlorobromide emulsion containing at least 90 molar % of silver chloride.

16 Claims, 2 Drawing Sheets

PROCESS FOR FORMING COLOR IMAGE

BACKGROUND OF THE INVENTION

The present invention relates to a process for forming a color image with a silver halide color photosensitive material. In particular, the present invention relates to a process for easily forming a color image without necessitating a desilverization step.

Various processes have been known for forming a color photographic image. Among them, a process wherein a silver halide emulsion is used and the development is conducted with a developer containing an aromatic primary amino color developing agent in the presence of a color coupler is usually employed. In this process, a desilverization step wherein developed silver formed together with a dye in a color development step is removed is necessitated, since the silver thus formed is usually black and impairs the color tone. The desilverization step comprises a step of bleaching the developed silver (bleaching step) and a step of removing undeveloped silver and bleached silver (fixing step). Therefore, the color photograph is prepared by the following treatment steps:

development ⟶ washing with water ⟶ first fixing ⟶ washing with water ⟶ bleaching ⟶ washing with water ⟶ second fixing ⟶ washing with water ⟶ stabilization

Recent advances in color photography have led to a strong need for, simplification of the treatment steps and reduction of treatment time. Various efforts have been made to improve both the solutions for treating photosensitive materials and the processing equipment. As a result, elimination of the intermediate step of washing with water and the desilverization step has been made possible. At present, a so-called bleach-fixing step wherein both bleaching and fixing are conducted in one step is practically employed. The most simplified color paper is treated at present by the following steps:

development→bleach-fixing→washing with water or stabilization.

Now, a further simplification of the process is desired. For further simplifying the process, a process wherein the development and desilverization are conducted in one step or a process wherein the step of washing with water or stabilization is omitted is possible. However, these processes are difficult and they have not been practically employed. Particularly the process wherein the development and desilverization are conducted in one step is quite difficult, since the development (a reduction reaction) must be conducted simultaneously with the bleaching (an oxidation reaction).

Several processes have been proposed for conducting the development and desilverization in one step. On pages 33 to 37 of Nippon Shashin Gakkai-shi, Vol. 21, No. 3 (1958), a mono-bath processing of a color film is reported. In this process, a positive color film is developed, fixed and desilvered (bleach-fixed) in one bath. It is also described therein that the processing solution has only a very short shelf life, that it generates ammonia gas and that it becomes turbid. It is quite difficult to use such a solution on an industrial scale and it has not been used in practice, though investigation thereof is interesting. U.S. Pat. No. 3,923,511 discloses the development/bleaching/fixing process for a photographic material with a single bath of aqueous alkali solution containing a developer, cobalt (11) complex and a solvent for the silver halide, and Japanese Patent Unexamined Published Application (hereinafter referred to as 'J. P. KOKAI') Nos. 49-54034 and 54-161333 also disclose the development/bleach/fixing process for a photosensitive material containing a developing assistant. Also this process has a defect of unstability of the processing solution. J. P. KOKAI Nos. 56-109346 and 61-77851 and Japanese Patent Publication for Opposition Purpose (hereinafter referred to as 'J. P. KOKOKU') No. 61-15422 disclose and intensification process. It is described therein that the desilverization process can be omitted, since a large amount of silver is not necessitated. However, this process also has not been employed in practice, since the solution is unstable like the solution used for the development/bleach/fixing and the compounds used are not sufficiently safe. J. P. KOKAI No. 54-137332 discloses that a photoprophic material comprising ferric or cobalt (II) complex salt of anionic polymer latex impregnated with a coupler is subjected to the development/fixing treatment in a single bath, i.e., a photosensitive material containing a bleaching agent is developed and fixed. Although this process is free from the problem of the instability of the processing solution, it has another problem that the stability of the photosensitive material is insufficient due to an interaction between the emulsion and bleaching agent.

J. P. KOKAI No. 54-137332 also describes, for comparison, the development and fixing of a color paper containing a silver chlorobromide emulsion and a coupler. The above-described Nippon Shashin Gakkai-shi, Vol. 21, No. 3 also discloses the development and fixing of color papers and color positive films available on the market at that time. However, problems such as unclear colors and prolongation of the development time remain unsolved.

U.S. Pat. No. 4,216,285 further discloses that when a movie color positive film (Eastman Color Print Film, type 5381 and type 7383) is processed with a single solution for the development and fixing with the pH and concentration of a solvent for silver halide contained in the solution maintained within a predetermined range, the covering power of the thus formed developed silver is low, so that its effect on unclear color of color image is reduced and simultaneously the developed silver remains. Thereby, a good image and photosoundtrack can be formed without employing any special process. However, problems such as unclear colors and prolongation of the development time remain unsolved.

SUMMARY OF THE INVENTION

As described above, although several processes wherein the development and desilverization are conducted in one step in the color development have been proposed, they still have problems and have not yet been employed on an industrial scale. Therefore, the first object of the present invention is to provide a process for forming a color image wherein the development and desilverization are conducted in one step. The second object of the present invention is to provide a process for forming a color image rapidly in a simple manner. These and other objects of the present invention will be clear from the following description and Examples.

These objects can be attained by developing a color photographic material comprising, on a support, at least one layer containing a coupler capable of forming a dye by reaction with an oxidized aromatic primary amino color developing agent and having a dye-covering power of at least 0.75, and a silver chlorobromide emulsion or silver chloroiodobromide emulsion containing at least 90 molar % of silver chloride with a processing solution containing a solvent for the silver halide in the presence of an aromatic primary amino color developer.

DESCRIPTION OF THE PREFERRED EMBODIMENTS

Figure 1:
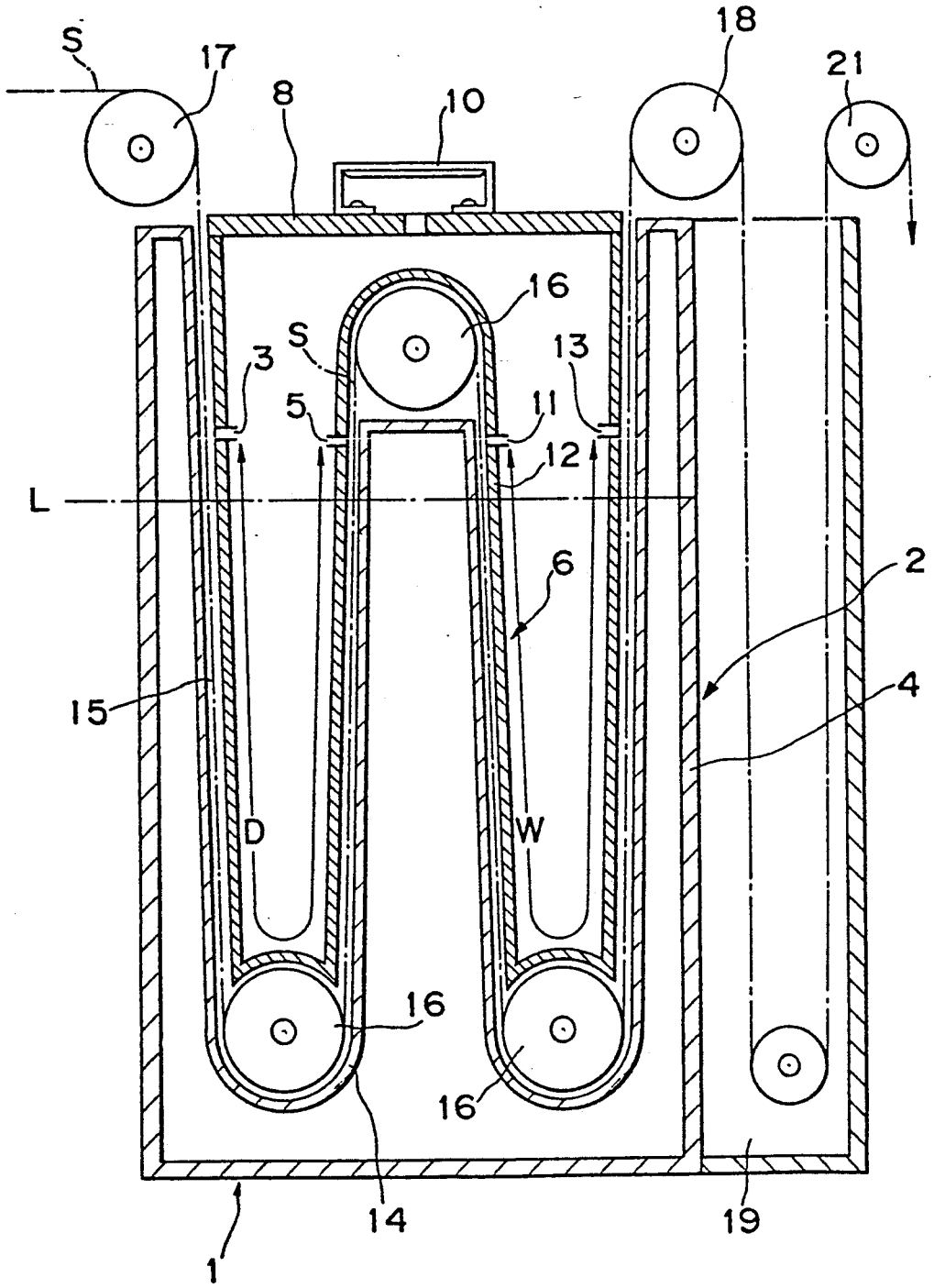
FIG. 1 shows a photographic developing machine used in the preset invention.

The term 'dye covering power' (hereinafter referred to as DCP) indicates the ratio of the dye concentration to the quantity of developed silver. DCP is easily determined by an experiment as follows:

| Preparation of samples for determination of DCP | |
|---|---|
| Amount of coupler for DCP determination: | 1 mmol/m$^2$ |
| Molar ratio of applied silver to coupler for DCP determination: | 8/1 |
| Gelatin protective layer: | 1 μm |
| Support: | undercoated cellulose triacetate film |

DETERMINATION OF DCP (1) The samples for the determination of DCP were exposed stepwise and then subjected to the following developing steps:

1. color development,
2. fixing, and
3. washing with water.

After drying, the amount of developed silver (S) was determined with a fluorescent X-ray silver meter in each step.

(2) After the quantitative determination of the developed silver, the same samples were subjected to the following desilverization steps:

1. bleach-fixing, and
2. washing with water.

After drying, the density was determined with a densitometer in each step. The densitometer used was an FDS-103 densitometer manufactured by Fuji Photo Film Co., Ltd. The interference filter used was such that the maximum absorption wave length ($\lambda_{max}$) for each color image was $\lambda_{max}\pm5$. The half value width of the transmission factor absorbance curve of the interference filter used was 7 to 10 nm.

The density thus determined was plotted for the amount of the developed silver (S, mmol/m$^2$) and the dye covering power (DCP) was determined from the slope of the straight line part [D/S, density/amount of developed silver (mmol/m$^2$)].

The compositions of the solutions used in the above-described processing steps were as follows:

| | | |
|---|---|---|
| Color developer | | |
| Triethanolamine | | 8.0 g |
| Sodium bromide | | 1.7 g |
| N-ethyl-N-(β-methanesulfonamidoethyl)-3-methyl-4-aminoaniline sulfate | | 5.0 g |
| N,N-Bis(carboxyethyl)hydrazine | | 5.0 g |
| Potassium carbonate | | 30.0 g |
| Water | ad | 1 l |
| pH: 10.05 | | |
| Fixing solution | | |
| Sodium thiosulfate | | 50.0 g |
| Water | ad | 1 l |
| Bleaching-fixing solution | | |
| Ammonium thiosulfate (700 g/l) | | 200.0 g |
| Sodium sulfite | | 40.0 g |
| Ferric (III) ethylenediaminetetraacetate | | 100.0 g |
| Disodium ethylenediaminetetraacetate | | 5.0 g |
| Ammonium bromide | | 40.0 g |
| Water | ad | 1 l |

The present invention is characterized in that the color development and desilverization are conducted in one bath by the development/fixing, though unstable development/bleaching/fixing or intensification has been employed in the prior art, and that in forming a color image by the development/fixing, a combination of a highly chlorinated silver emulsion and a coupler having a high DCP is used in order to solve the problems of prolongation of the development time and unclearness of the colors due to remaining developed silver.

When a photosensitive material containing the highly chlorinated silver emulsion and high-DCP coupler is developed and fixed according to the present invention, the problems of the unclearness of the colors due to remaining developed silver and the prolongation of the development time are solved, since the high-DCP coupler has an excellent effect and the developed silver thus formed has a covering power lower than that formed by an ordinary development. Although the mechanism of this phenomenon has not yet been elucidated, it is quite surprising.

The highly chlorinated silver used in the present invention must be silver chlorobromide or silver chloroiodobromide. When pure silver chloride is used, the object cannot be attained due to reduction of the image density or increase of fog.

Any couplers having a dye covering power (DCP) of at least 0.75 can be advantageously used. However, the couplers satisfying this requirement are limited. The higher the conversion efficiency of the silver halide into the dye and the absorbance of the formed dye, the higher DCP of the coupler. Most of ordinarily used, so-called tetraequivalent couplers (couplers necessitating 4 mol of silver for forming 1 mol of the dye), do not satisfy this requirement due to an insufficient conversion efficiency into the dye.

As the couplers, so-called diequivalent couplers are preferred. Among them, those represented by the following general formula (1):

Cp-X (1)

wherein Cp represents a mother nucleus of the coupler and X represents a coupling-off group are particularly preferred.

The color photosensitive material usually comprises a yellow coupler, magenta coupler and cyan coupler which display yellow, magenta and cyan, respectively, upon coupling with an oxidized aromatic amine color developing agent.

Among the yellow couplers usable in the present invention, acyl acetamide derivatives such as benzoyl acetoanilide and pivaloyl acetoanilide are preferred.

Yellow couplers represented by the following general formulae [Y-1] and [Y-2] are particularly preferred:

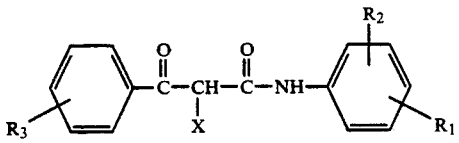

[Y-1]

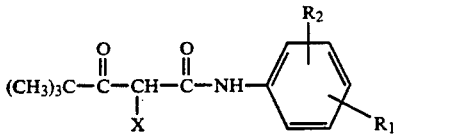

[Y-2]

wherein X represents a coupling-off group, $R_1$ represents a diffusion-resistant group having a total carbon number of 8 to 32, $R_2$ represents a hydrogen atom, one or more halogen atoms, lower alkyl group, lower alkoxy group or diffusion-resistant group having a total carbon number of 8 to 32, $R_3$ represents a hydrogen atom or a substituent and when two or more $R_3$ groups are present, they may be either the same or different from one another.

The pivaloyl acetoanilide-type yellow couplers are described in detail in U.S. Pat. No. 4,622,287 (from line 15, column 3 to line 39, column 8) and U.S. Pat. No. 4,623,616 (from line 50, column 14 to line 41, column 19).

The details of the benzoyl acetoanilide-type yellow couplers are described in, for example, U.S. Pat. Nos. 3,408,194, 3,933,501, 4,046,575, 4,133,958 and 4,401,752.

Examples of the pivaloyl acetoanilide-type yellow couplers include compounds (Y-1) to (Y-39) described in columns 37 to 54 of the above-mentioned U.S. Pat. No. 4,622,287. Among them, particularly preferred are compounds (Y-1), (Y-4), (Y-6), (Y-7), (Y-15), (Y-21), (Y-22), (Y-23), (Y-26), (Y-35), (Y-36), (Y-37), (Y-38) and (Y-39).

They also include compounds (Y-1) to (Y-33) described in columns 19 to 24 of the above-mentioned U.S. Pat. No. 4,623,616. Among them, particularly preferred are compounds (Y-2), (Y-7), (Y-8), (Y-12), (Y-20), (Y-21), (Y-23) and (Y-29).

The preferred compounds further include a typical example (34) described in column 6 of U.S. Pat. No. 3,408,194, compounds (16) and (19) described in column 8 of U.S. Pat. No. 3,933,501, compound (9) described in columns 7 and 8 of U.S. Pat. No. 4,046,575, compound (1) in columns 5 and 6 of U.S. Pat. No. 4,133,958, compound 1 in column 5 of U.S. Pat. No. 4,401,752 and the following compounds a) to h):

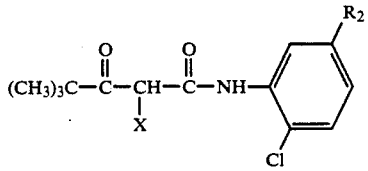

| Compound | $R_2$ | X |
|---|---|---|
| a | $-CO_2CH(CH_3)CO_2C_{12}H_{25}$ | 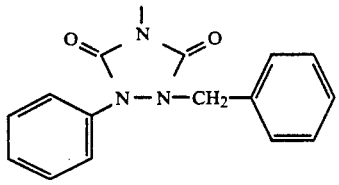 |
| b | $-CO_2CH(C_4H_9)CO_2C_{12}H_{25}$ | " |
| c | 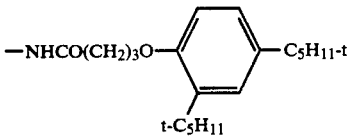 | 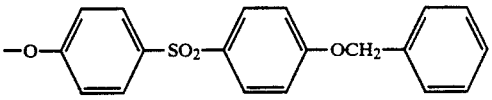 |
| d | " | 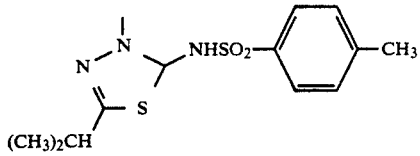 |

-continued

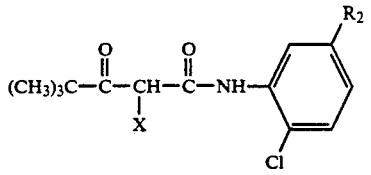

| Compound | $R_2$ | X |
|---|---|---|
| e | " | 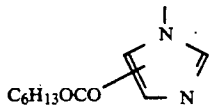 |
| f | $-NHSO_2C_{12}H_{25}$ | 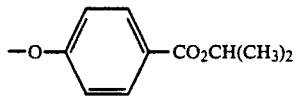 |
| g | $-NHSO_2C_{16}H_{33}$ | 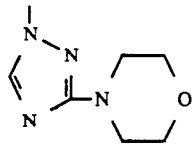 |
| h | $-NHCO\underset{\underset{CH_3}{\vert}}{C}HCH_2SO_2C_{12}H_{25}$ | 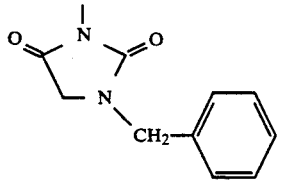 |

Among the above-described couplers, those which split off nitrogen atom are particularly preferred.

Typical examples of the yellow couplers usable in the present invention including those described above will be shown below, which by no means limit the couplers:

| No. | Yellow coupler (Y-1) $Q_1$ | $(CH_3)_3COCH-Q_1$ ($X_1$) $X_1$ |
|---|---|---|
| Y-I 1 | 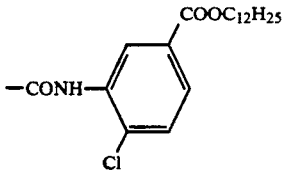 | 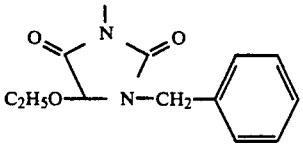 |
| 2 | 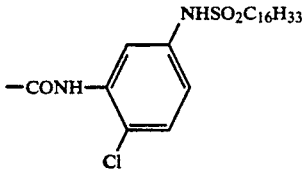 | " |

-continued
| No. | Yellow coupler (Y-1) $Q_1$ | $(CH_3)_3COCH(X_1)-Q_1$ $X_1$ |
|---|---|---|
| 3 | 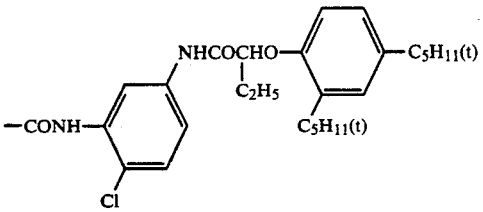 | " |
| 4 | 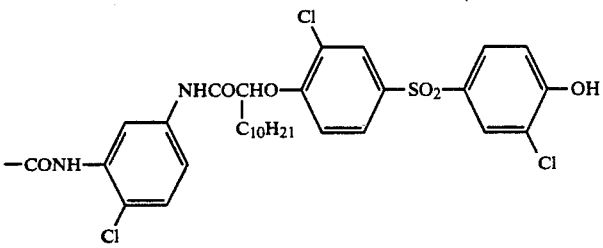 | 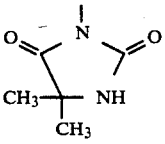 |
| 5 | 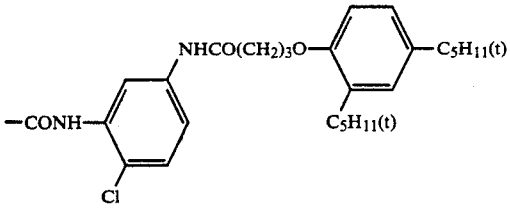 | 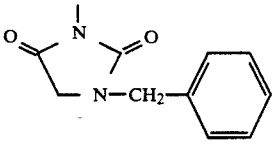 |
| 6 | 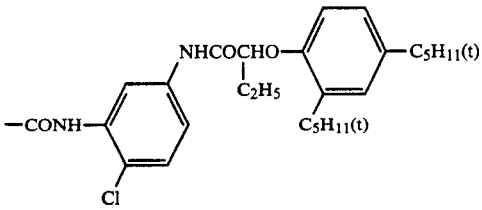 | 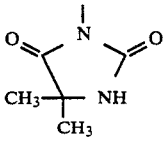 |
| 7 | 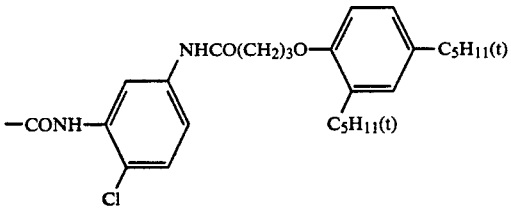 | 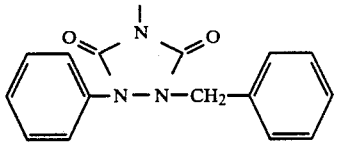 |
| Y-I 8 | 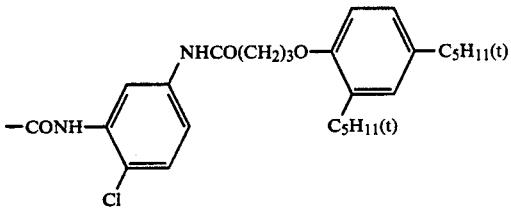 | 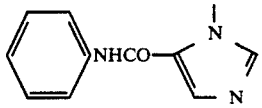 |
| 9 | " | 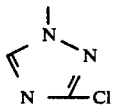 |

-continued
| No. | Yellow coupler (Y-1) $Q_1$ | $(CH_3)_3COCH(X_1)-Q_1$ $X_1$ |
|---|---|---|
| 10 | " | 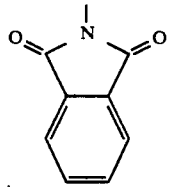 |
| 11 | 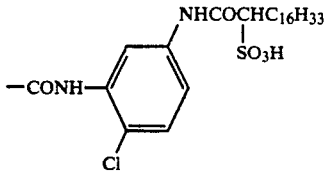 | 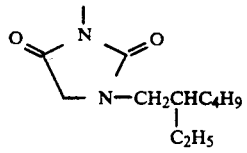 |
| 12 | 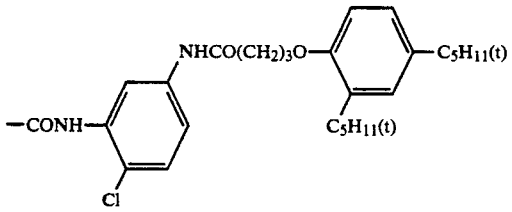 | 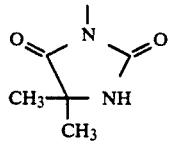 |
| 13 | 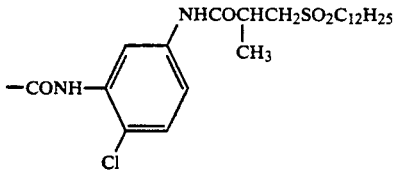 | 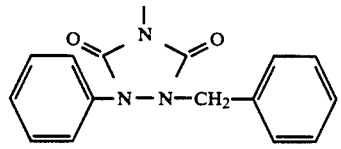 |
| 14 | 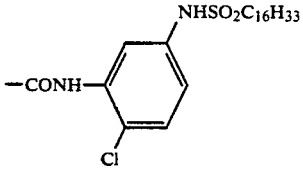 | " |
| 15 | 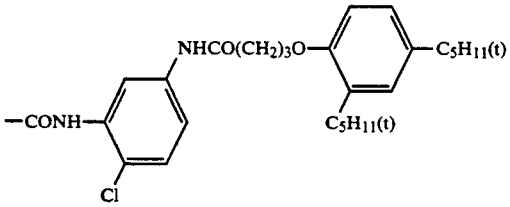 | 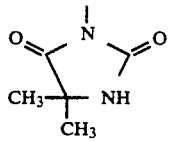 |
| Y-I 16 | " | 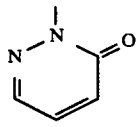 |
| 17 | 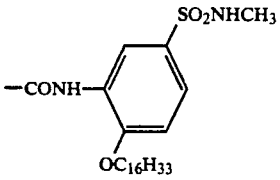 | 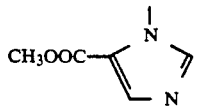 |

-continued
| No. | Yellow coupler (Y-1) $Q_1$ | $(CH_3)_3COCH(X_1)-Q_1$ $X_1$ |
|---|---|---|
| 18 | 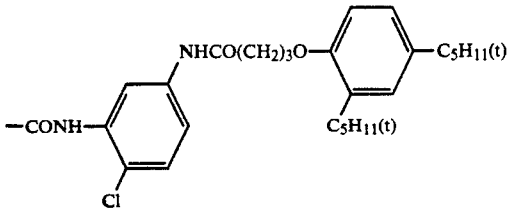 | 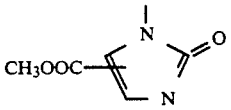 |
| 19 | " | 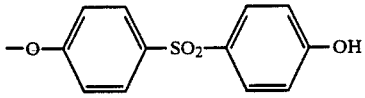 |
| 20 | " | 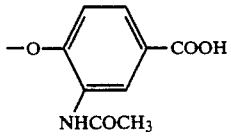 |
| 21 | 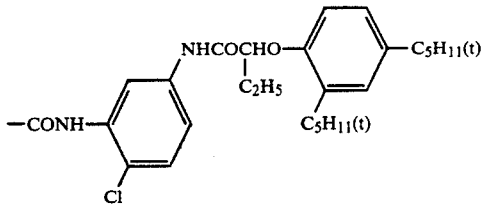 | 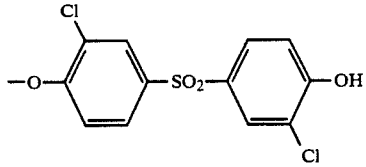 |
| 22 | 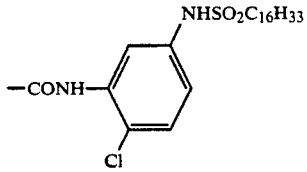 | " |
| 23 | 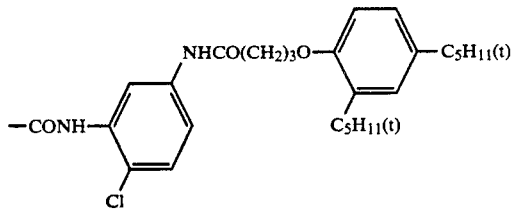 | 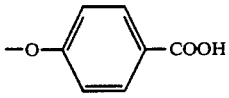 |
| Y-I 24 | 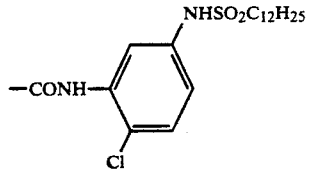 | 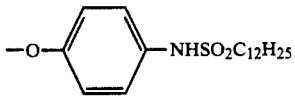 |
| 25 | 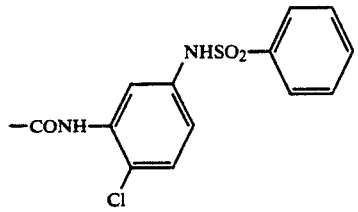 | 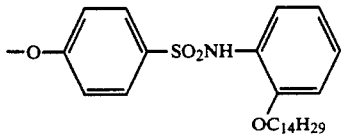 |

-continued
| No. | Yellow coupler (Y-1) $Q_1$ | $(CH_3)_3COCH(X_1)-Q_1$ $X_1$ |
|---|---|---|
| 26 | 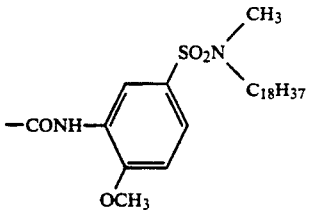 | 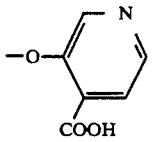 |
| No. Y-II | R | Yellow coupler (Y-II) $R-COCH(X_z)-Q_z$ $Q_2$ | $X_2$ |
|---|---|---|---|
| 1 | 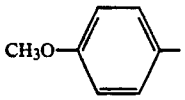 | 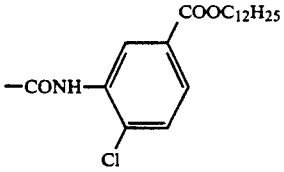 | 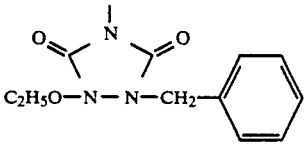 |
| 2 | " | 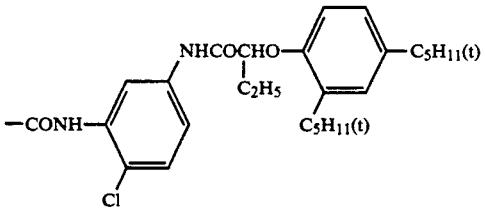 | " |
| 3 | " | 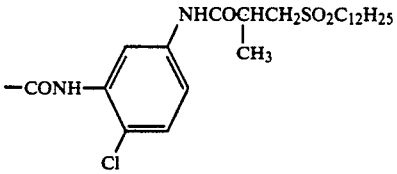 | 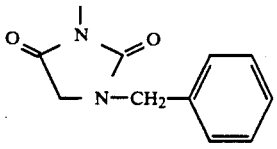 |
| 4 | " | 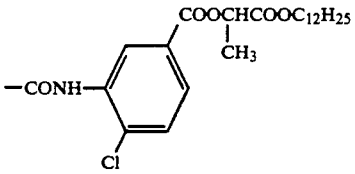 | 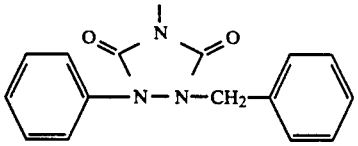 |
| 5 | 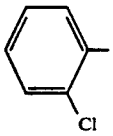 | 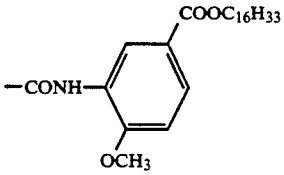 | 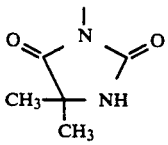 |
| 6 | 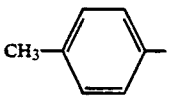 | 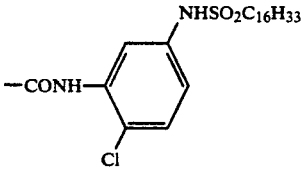 | 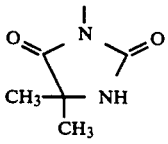 |

-continued

Yellow coupler (Y-II)

$R-COCH(X_z)-Q_z$

| No. Y-II | R | $Q_2$ | $X_2$ |
|---|---|---|---|
| 7 | 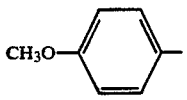 | 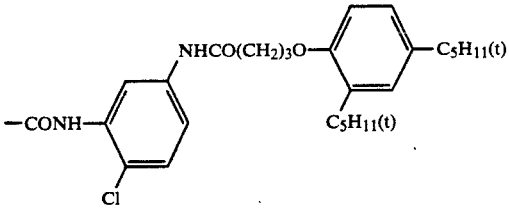 | 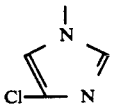 |
| 8 | " | 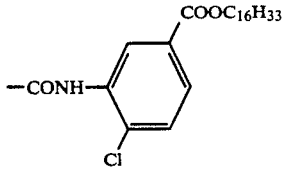 | 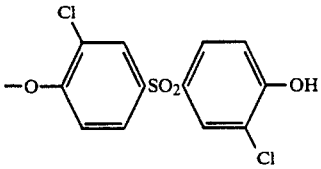 |
| 9 | 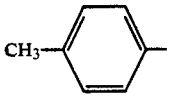 | 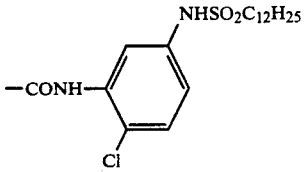 | 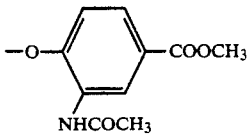 |

The magenta couplers usable in the present invention include oil-protected indazolone or cyanoacetyl couplers, preferably pyrazolone or pyrazoloazole couplers such as pyrazolotriazoles. The 5-pyrazolone couplers preferably have an arylamino or acylamino substituent at 3-position thereof from the viewpoint of the hue of the dye or density of the color. Typical examples of such couplers are described in U.S. Pat. Nos. 2,311,082, 2,343,703, 2,600,788, 2,908,573, 3,062,653, 3,152,896 and 3,936,015. The splitting-off group of the diequivalent 5-pyrazolone couplers is preferably a nitrogen atom-splitting group described in U.S. Pat. No. 4,310,619, or an arylthio group described in U.S. Pat. No. 4,351,897 or International Patent Publication WO-88-4795. When a 5-pyrazolone coupler having a ballast group described in European Patent No. 73,636 is used, a high color density can be obtained.

The pyrazoloazole couplers include pyrazolobenzimidazoles described in U.S. Pat. No. 2,369,879, preferably pyrazolo-[5,1-c][1,2,4]triazoles described in U.S. Pat. No. 3,725,067, pyrazolotetrazoles described in Research Disclosure 24220 (June, 1984) and pyrazolopyrazoles described in Research Disclosure 24230 (June, 1984). These couplers may be polymer couplers.

These compounds are shown by the following general formulae (M-1), (M-2) or (M-3):

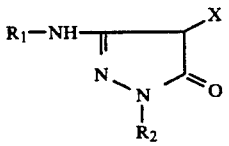

[M-1]

-continued

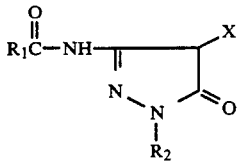

[M-2]

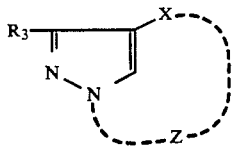

[M-3]

wherein $R_1$ represents a diffusion-resistant group having 8 to 32 carbon atoms in total, $R_2$ represents a phenyl group or substituted phenyl group, $R_3$ represents a hydrogen atom or substituent, Z represents a non-metallic atomic group necessary for forming a five-membered azole ring having 2 to 4 nitrogen atoms which azole ring may have a substituent (including a condensed ring), and X represents a splitting-off group.

The details of the Substituents of $R_3$ and those of the azole rings are described in, for example, U.S. Pat. No. 4,540,654 (from line 41, column 2 to line 27, column 8).

Among the pyrazoloazole couplers, imidazo[1,2-b]pyrazoles described in U.S. Pat. No. 4,500,630 are preferred because of low yellow sub-absorption and light fastness of the developed dye, and pyrazolo[1,5-c][1,2,4]triazole described in U.S. Pat. No. 3,725,067 and J.P. KOKOKU No. 47-27411 is also preferred. Pyrazolo-[1,5-b][1,2,4]triazole described in U.S. Pat. No. 4,540,654 and J.P. KOKAI Nos. 59-171956 and 60-172982 is particularly preferred.

Further preferred are pyrazolotriazole couplers having a branched alkyl group bonded at 2, 3 or 6-position of the pyrazolotriazole ring as described in J.P. KOKAI No. 61-65245, pyrazoloazole couplers having a sulfonamido group in the molecule as described in J.P. KOKAI No. 61-65246, pyrazoloazole couplers having an alkoxyphenylsulfonamido ballast group as described in J.P. KOKAI No. 61-147254 and pyrazolotriazole couplers having an alkoxy group or aryloxy group at 6-position as described in European Patent Publication No. 226,849.

Typical examples of the magenta couplers usable in the present invention will be given below, which by no means limit the couplers usable in the invention.

Magenta coupler (M-1)

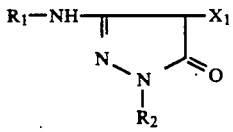

| Coupler M-1 | $R_1$ | $R_2$ | $X_1$ |
|---|---|---|---|
| -1 | 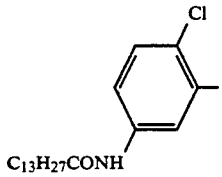 | 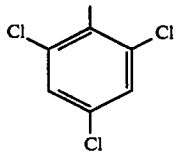 | 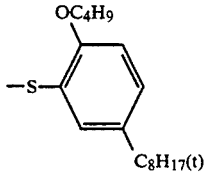 |
| -2 | 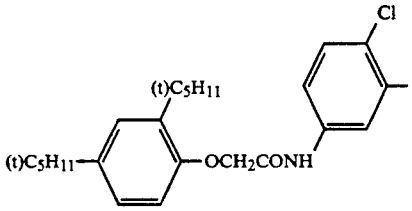 | " | 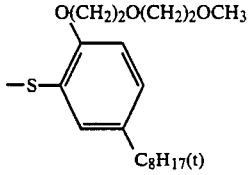 |
| -3 | 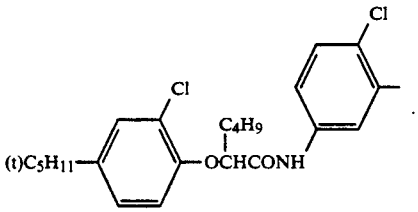 | " | 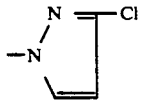 |
| -4 | 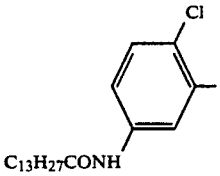 | " | 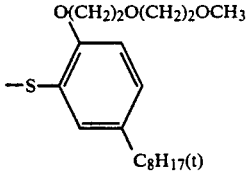 |
| -5 | " | " | 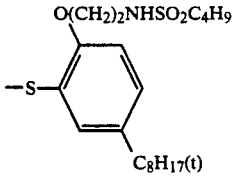 |
| -6 | 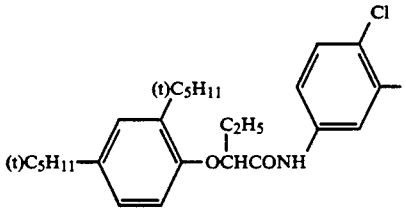 | " | 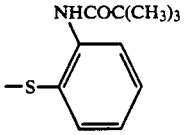 |

-continued
Magenta coupler (M-1)
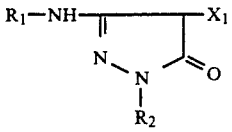
| Coupler M-I | $R_1$ | $R_2$ | $X_1$ |
|---|---|---|---|
| -7 | 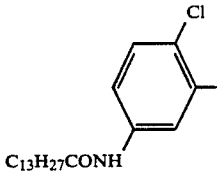 | " | " |
| -8 | 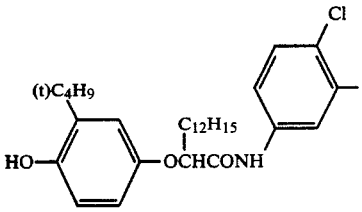 | 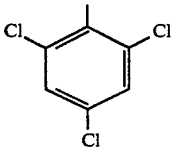 | " |
| -9 | 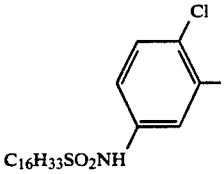 | " | 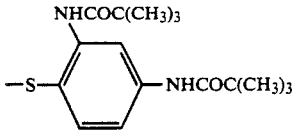 |
| -10 | 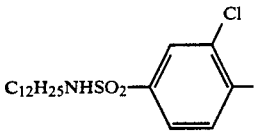 | " | " |
| -11 | 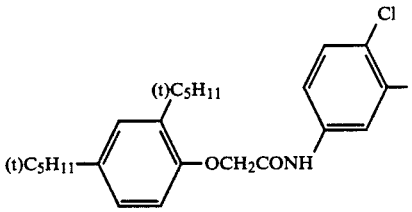 | " | 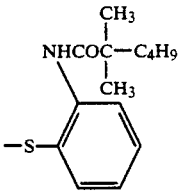 |
| -12 | 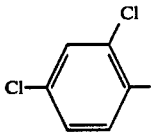 | " | 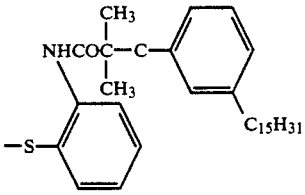 |
| -13 | 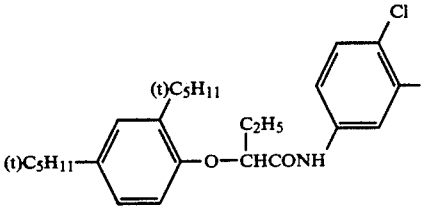 | " | 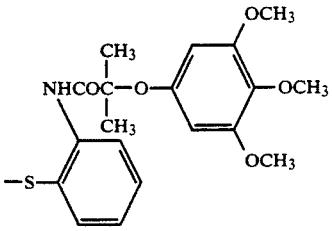 |

-continued
Magenta coupler (M-1)
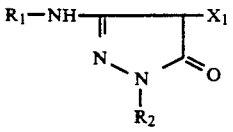
| Coupler M-I | $R_1$ | $R_2$ | $X_1$ |
|---|---|---|---|
| -14 | 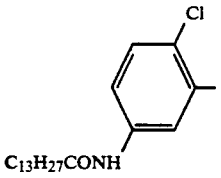 | " | 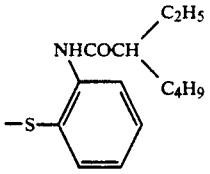 |
| -15 | 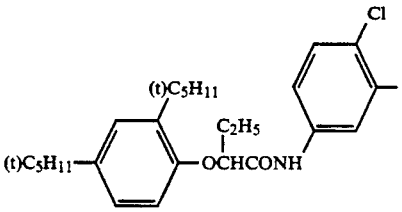 | 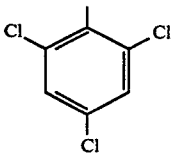 | 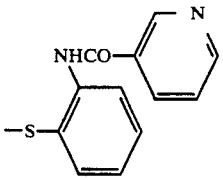 |
| -16 | 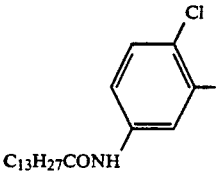 | " | 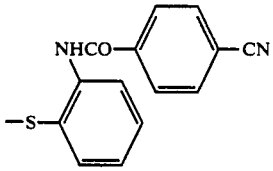 |
| -17 | 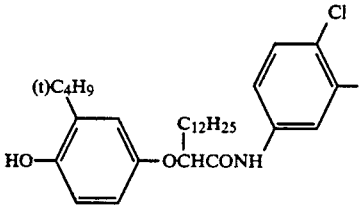 | " | 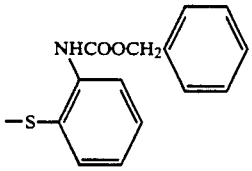 |
| -18 | 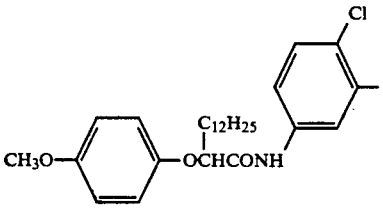 | " | 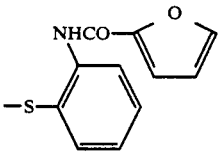 |
| -19 | 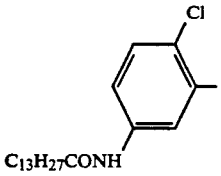 | " | 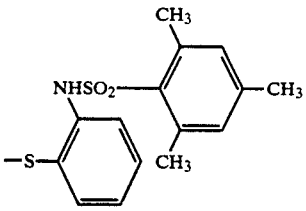 |
| -20 | " | " | 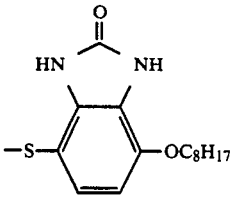 |

-continued
Magenta coupler (M-1)
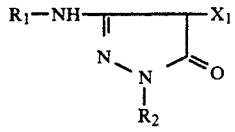
| Coupler M-I | $R_1$ | $R_2$ | $X_1$ |
|---|---|---|---|
| -21 | " | " | 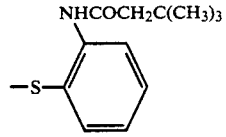 |
| -22 | 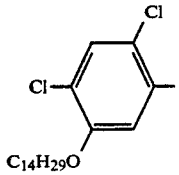 | 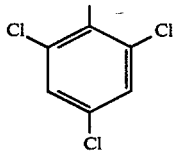 | 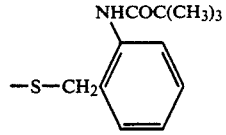 |
| -23 | 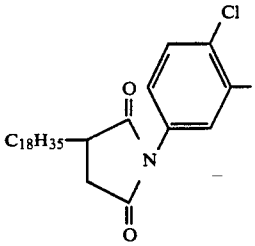 | " | 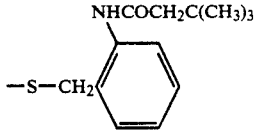 |
| -24 | 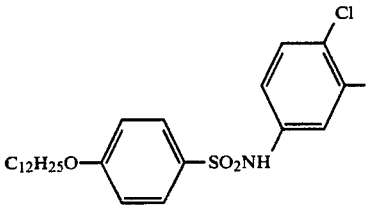 | " | 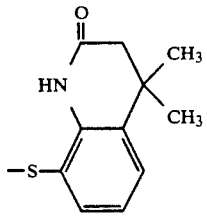 |
| -25 | 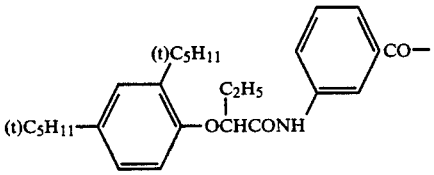 | " | 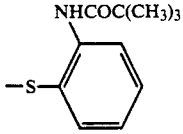 |
| -26 | 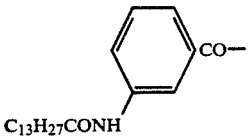 | " | 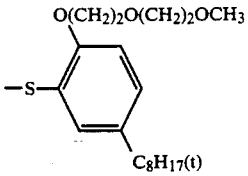 |
| -27 | 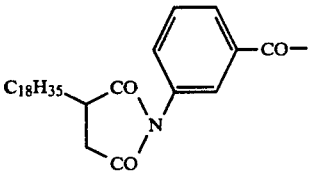 | " | 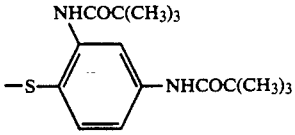 |

Magenta coupler (M-II)
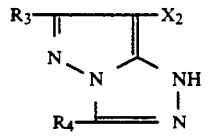
| Coupler M-II | $R_3$ | $R_4$ | $X_2$ |
|---|---|---|---|
| -1 | $CH_3$ | 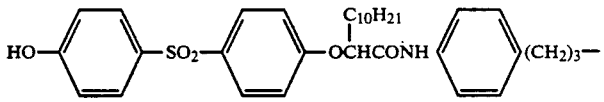 | Cl |
| -2 | $CH_3$ | 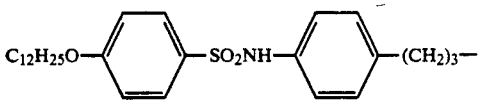 | Cl |
| -3 | 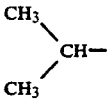 | 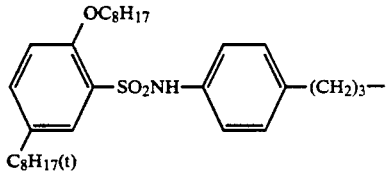 | Cl |
| -4 | $CH_3$ | 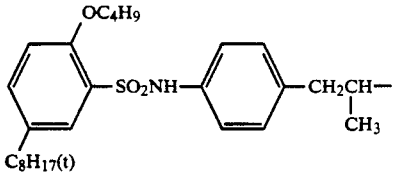 | Cl |
| -5 | 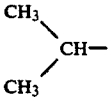 | 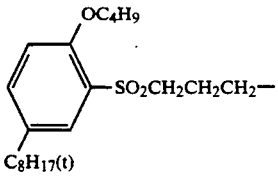 | Cl |
| -6 | 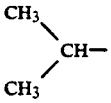 | 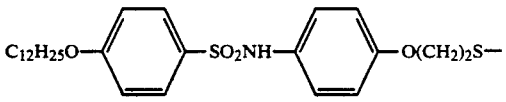 | 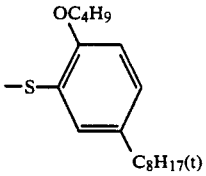 |
| -7 | $CH_3$— | 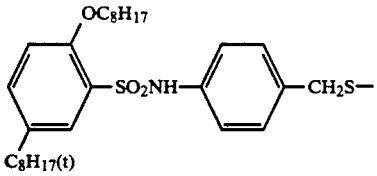 | 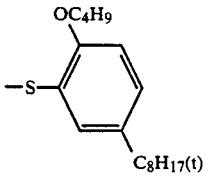 |
| -8 | $(CH_3)_3C$— | 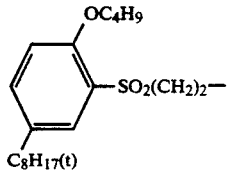 | Cl |

-continued
Magenta coupler (M-II)
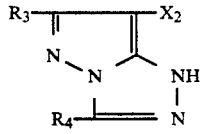
| Coupler M-II | $R_3$ | $R_4$ | $X_2$ |
|---|---|---|---|
| -9 | $CH_3$— | 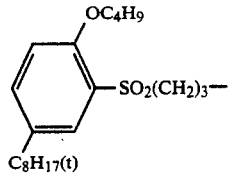 | 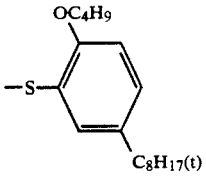 |
| -10 | $CH_3$— | 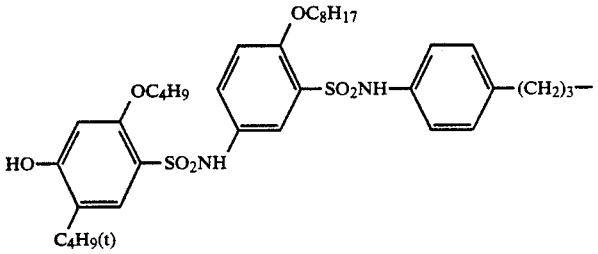 | Cl |
| -11 | $CH_3$— | 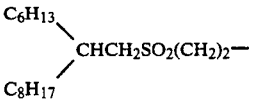 | Cl |

Magenta coupler (M-III)
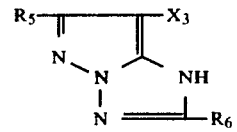
| Coupler M-III | $R_5$ | $R_6$ | $X_3$ |
|---|---|---|---|
| -1 | $CH_3$ | 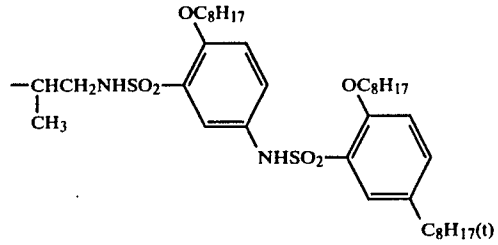 | Cl |
| -2 | $CH_3$ | 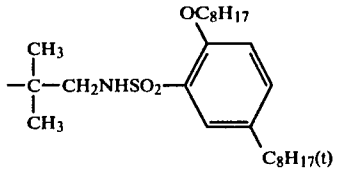 | Cl |
| -3 | $C_2H_5O$— | 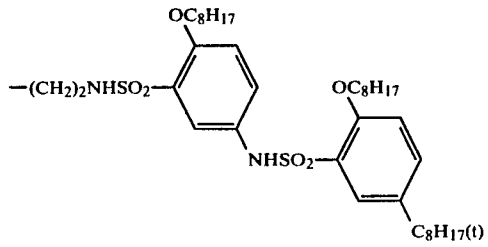 | 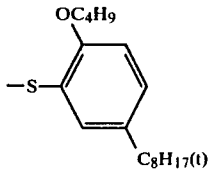 |

-continued
Magenta coupler (M-III)
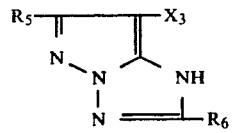
| Coupler M-III | $R_5$ | $R_6$ | $X_3$ |
|---|---|---|---|
| -4 | 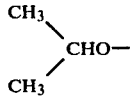 | 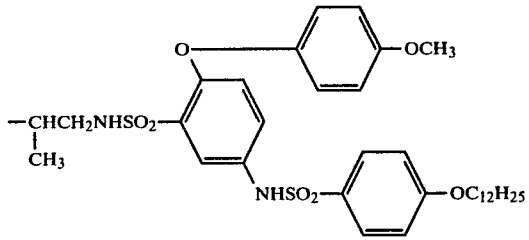 | 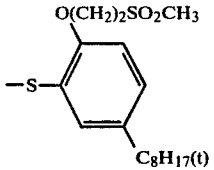 |
| -5 | $CH_3O(CH_2)_2O-$ | 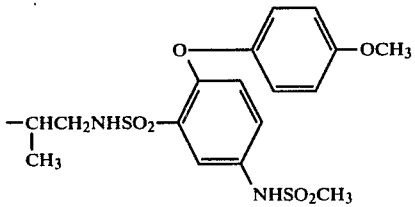 | 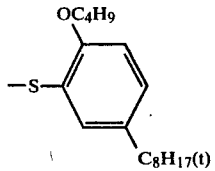 |
| -6 | $CH_3NHCONH-$ | 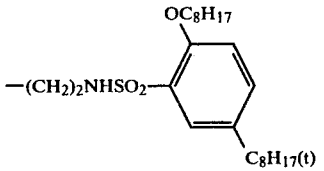 | " |
| -7 | 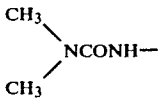 | 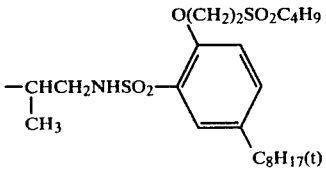 | 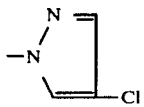 |

-continued
Magenta coupler (M-III)
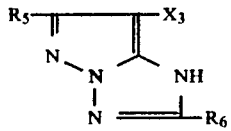
| Coupler M-III | $R_5$ | $R_6$ | $X_3$ |
|---|---|---|---|
| -8 | $CF_3CH_2O-$ | 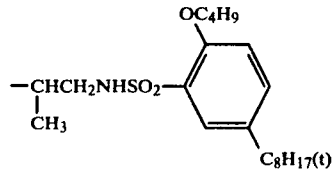 | 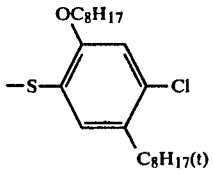 |
| -9 | 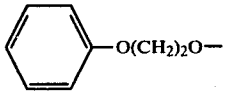 | 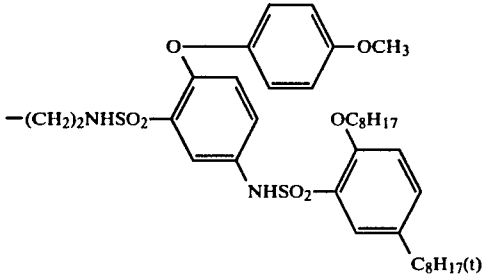 | 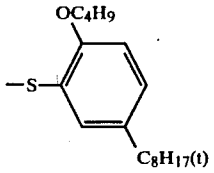 |
| -10 | $CH_3SO_2(CH_2)_2O-$ | 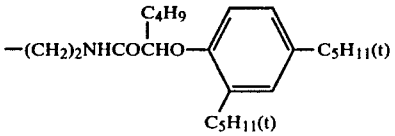 | " |

-continued
Magenta coupler (M-III)
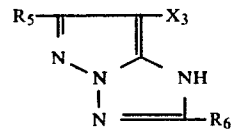
| Coupler M-III | $R_5$ | $R_6$ | $X_3$ |
|---|---|---|---|
| -11 | $CH_3$ / CH— / $CH_3$ | COOH, OCH, $C_5H_{11}$, $-(CH_2)_2NHSO_2-$, $OC_8H_{17}$, $NHSO_2-$, $C_8H_{17}(t)$ | —S— $OC_{12}H_{25}$ |
| -12 | $CH_3$ | $OCH_2CH_2OC_2H_5$, $-CHCH_2NHSO_2-$ ($CH_3$), $OC_8H_{17}$, $NHSO_2-$, $C_8H_{17}(t)$ | Cl |
| -13 | $CH_3$ | $OCH_2CH_2OC_6H_{13}$, $-CHCH_2NHSO_2-$ ($CH_3$), $C_8H_{17}(t)$ | Cl |

-continued
Magenta coupler (M-III)
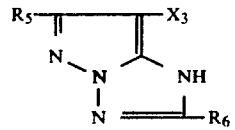
| Coupler M-III | $R_5$ | $R_6$ | $X_3$ |
|---|---|---|---|
| -14 | 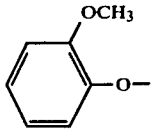 | 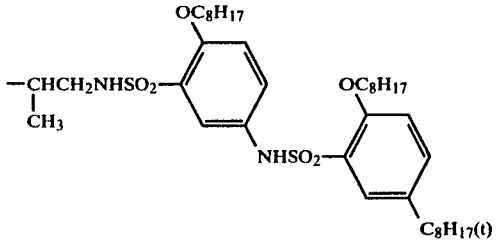 | 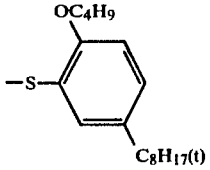 |
| -15 | 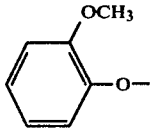 | 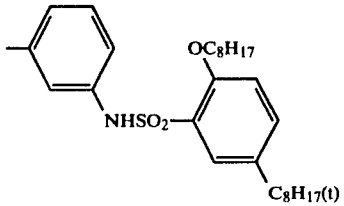 | " |
| -16 | 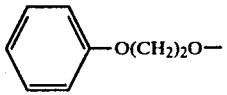 | 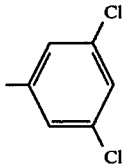 | 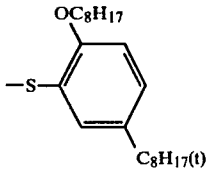 |
| -17 | 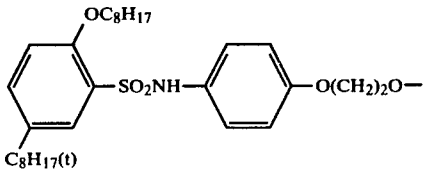 | 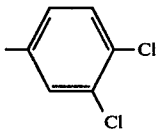 | 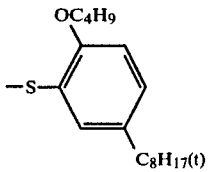 |

-continued
Magenta coupler (M-III)
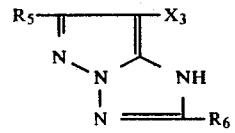
| Coupler M-III | $R_5$ | $R_6$ | $X_3$ |
|---|---|---|---|
| -18 | $CH_3$ | 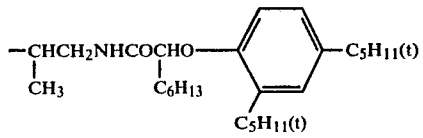 | Cl |

The most typical cyan couplers are phenolic cyan couplers and naphtholic cyan couplers.

The phenolic cyan couplers include those having an acylamino group at the 2-position of the phenol nucleus and an alkyl group at the 5-position thereof (including polymer couplers) as described in U.S. Pat. Nos. 2,369,929, 4,518,687, 4,511,647 and 3,772,002. Typical examples include a coupler described in Example 2 of Canadian Patent No. 625,822, Compound (1) described in U.S. Pat. No. 3,722,002, Compounds (I-4) and (I-5) described in U.S. Pat. No. 4,564,590, Compounds (1), (2), (3) and (24) described in J.P. KOKAI No. 61-39045 and Compound (C-2) described in J.P. KOKAI No. 62-70846.

The phenolic cyan couplers also include 2,5-diacylaminophenolic couplers described in U.S. Pat. Nos. 2,772,162, 2,895,826, 4,334,011 and 4,500,653 and J.P. KOKAI No. 59-164555. Typical examples include Compound (V) described in U.S. Pat. No. 2,895,826, Compound (17) in U.S. Pat. No. 4,557,999, Compounds (2) and (12) in U.S. Pat. No. 4,565,777, Compound (4) in U.S. Pat. No. 4,124,396 and Compound (I-19) in U.S. Pat. No. 4,613,564.

The phenolic cyan couplers further include those having a itrogen-containing heterocyclic ring condensed with the phenol nucleus as described in U.S. Pat. Nos. 4,372,173, 4,564,586 and 4,430,423, J.P. KOKAI No. 61-390441 and Japanese Patent Application No. 61-100222. Typical examples include Couplers (1) and (3) described in U.S. Pat. No. 4,327,173, Compounds (3) and (15) in U.S. Pat. No. 4,564,586, Compounds (1) and (3) in U.S. Pat. No. 4,430,423, and the following compounds:

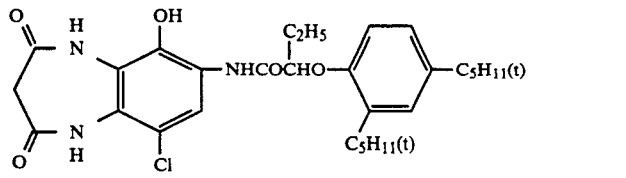

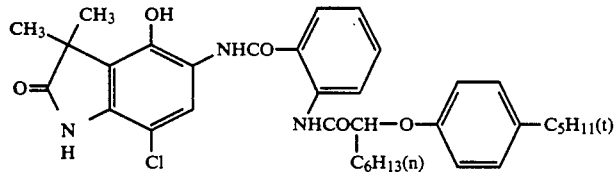

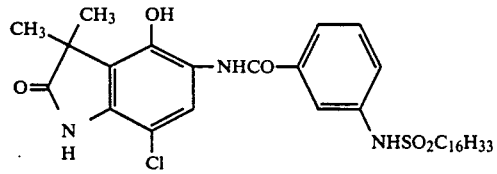

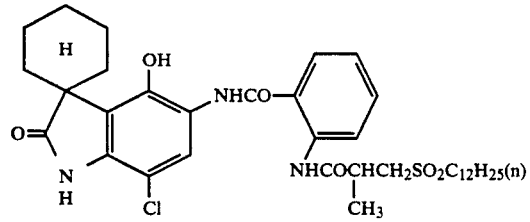

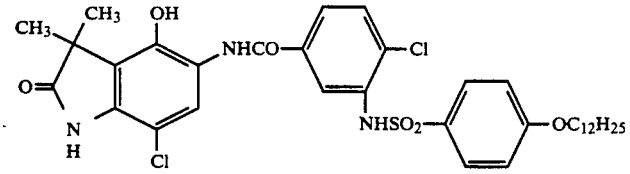

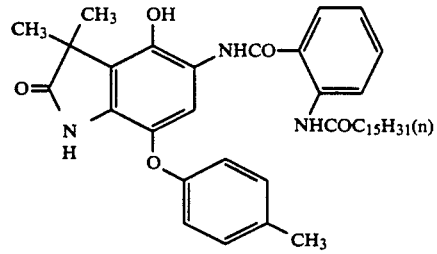

-continued
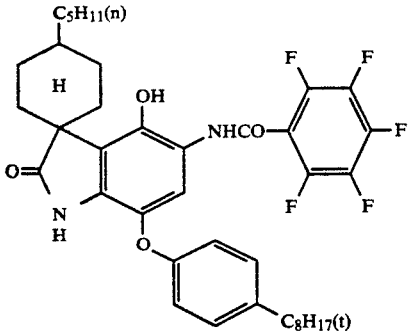
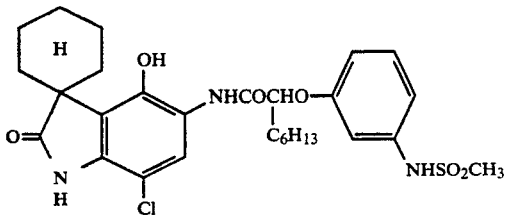
Diphenylimidazole cyan couplers described in European Patent Publication EP 0,249,453A2 can be used in addition to the above-described cyan couplers.
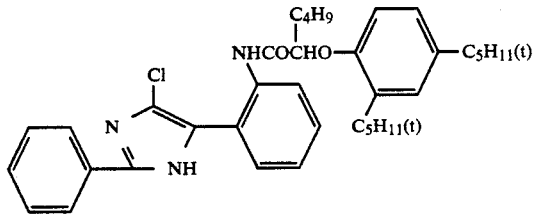
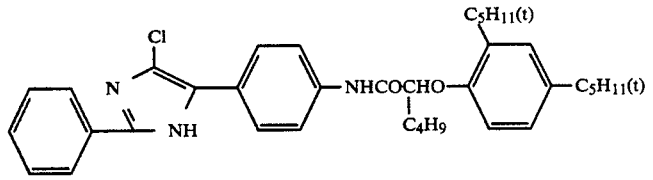
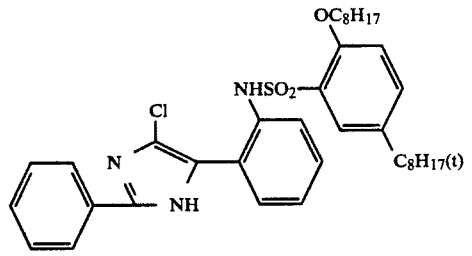
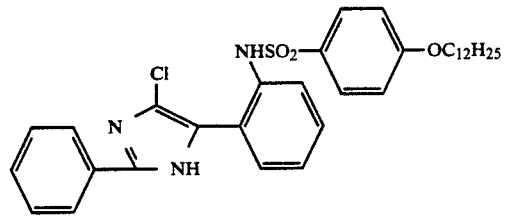

-continued

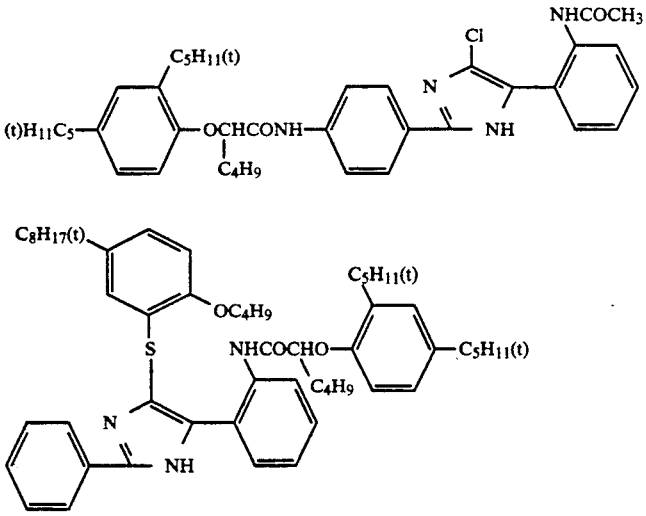

The phenolic cyan couplers include ureide couplers described in U.S. Pat. Nos. 4,333,999, 4,451,559, 4,444,872, 4,427,767 and 4,579,813 and European Patent (EP) No. 067,689B1. Typical exmaples include Coupler (7) described in U.S. Pat. No. 4,333,999, Coupler (1) in U.S. Pat. No. 4,451,559, Coupler (14) in U.S. Pat. No. 4,444,872, Coupler (3) in U.S. Pat. No. 4,427,767, Couplers (6) and (24) in U.S. Pat. No. 4,609,619, Couplers (1) and (11) in U.S. Pat. No. 4,579,813, Couplers (45) and (50) in European Patent (EP) No. 067,689 B1 and Coupler (3) in J.P. KOKAI No. 61-42658.

The naphthol cyan couplers include those having an N-alkyl-N-arylcarbamoyl group at the 2-position of its naphthol nucleus (for example, U.S. Pat. No. 2,313,586), those having an alkylcarbamoyl group at the 2-position (for example, U.S. Pat. Nos. 2,474,293 and 4,282,312), those having an arylcarbamoyl group at the 2-position (for example, J.P. KOKAI No. 50-14523), those having a carbonamido or sulfonamido group at the 5-position (for example, J.P. KOKAI Nos. 60-237448, 61-145557 and 61-153640), those having an aryloxy splitting-off group (for example, U.S. Pat. No. 3,476,563), those having a substituted alkoxy splitting-off group (for example, U.S. Pat. No. 4,296,199) and those having a glycolic acid splitting-off group (for example, J.P. KOKOKU No. 60-39217).

3-Hydroxypyridine cyan couplers described in Japanese Patent Application No. 63-62825 can be used in addition to the above-described cyan couplers. Typical examples are as follows:

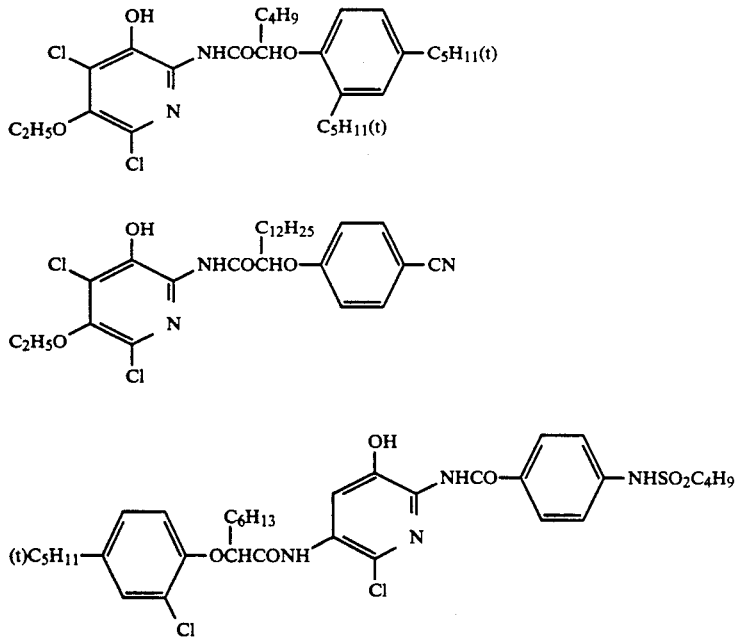

Typical examples of the cyan couplers usable in the present invention will be given below, which by no means limit the present invention.

Cyan coupler (C-1)
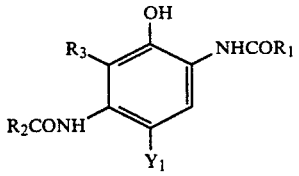
| Coupler C-I | $R_1$ | $R_2$ | $R_3$ | $Y_1$ |
|---|---|---|---|---|
| -1 | $-C_3F_7$ | 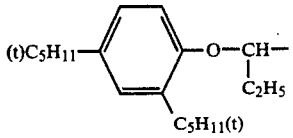 | H | Cl |
| -2 | 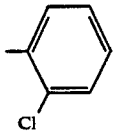 | 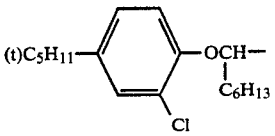 | H | Cl |
| -3 | 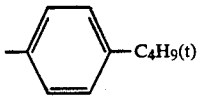 | 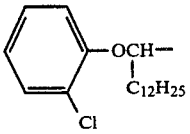 | H | Cl |
| -4 | 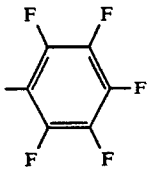 | 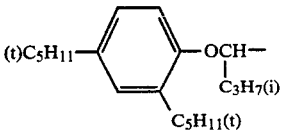 | H | Cl |
| -5 | 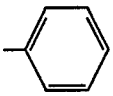 | 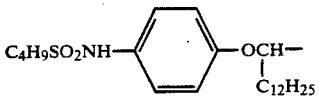 | H | Cl |
| -6 | 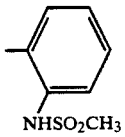 | 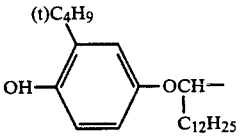 | H | Cl |
| -7 | 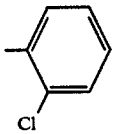 | 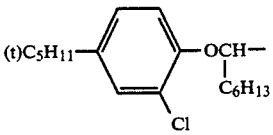 | $C_3H_7$ | Cl |
| -8 | 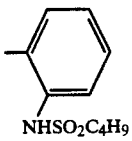 | 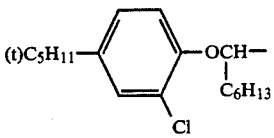 | H | Cl |
| -9 | 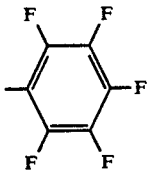 | 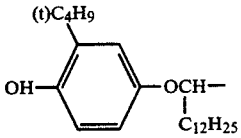 | H | Cl |

-continued
Cyan coupler (C-1)
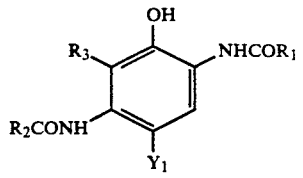
| Coupler C-I | $R_1$ | $R_2$ | $R_3$ | $Y_1$ |
|---|---|---|---|---|
| -10 | 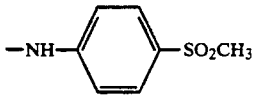 | 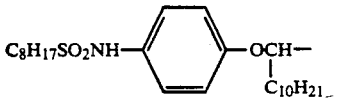 | H | Cl |
| -11 | 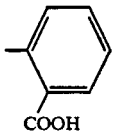 | 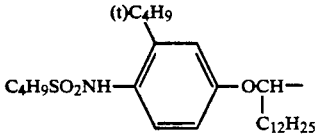 | H | Cl |
| -12 | 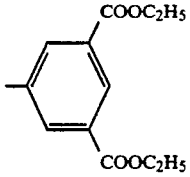 | 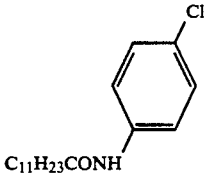 | H | Cl |
| -13 | 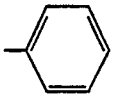 | 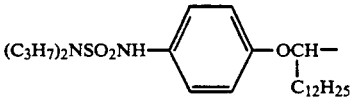 | H | Cl |
| -14 | 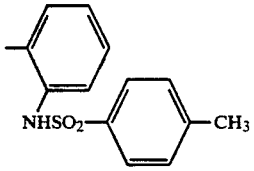 | 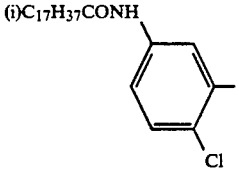 | H | Cl |
| -15 | 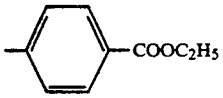 | 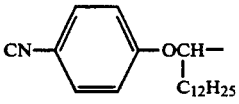 | H | Cl |
| -16 | 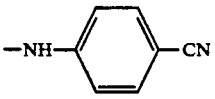 | 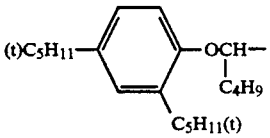 | H | Cl |
| -17 | 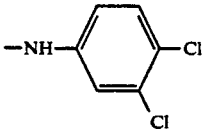 | 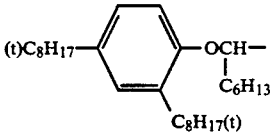 | H | Cl |

-continued
Cyan coupler (C-I)
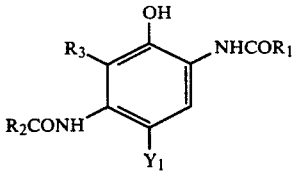
| Coupler C-I | $R_1$ | $R_2$ | $R_3$ | $Y_1$ |
|---|---|---|---|---|
| -18 | 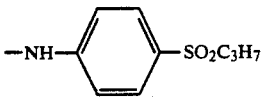 | 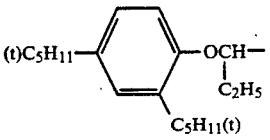 | H | 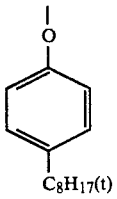 |
Cyan coupler (C-II)
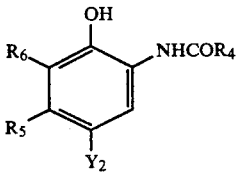
| Coupler C-II | $R_4$ | $R_5$ | $R_6$ | $Y_2$ |
|---|---|---|---|---|
| -1 | 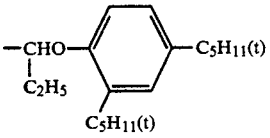 | $-CH_3$ | Cl | Cl |
| -2 | " | $-C_2H_5$ | Cl | Cl |
| -3 | 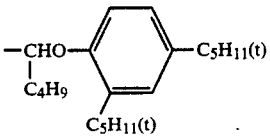 | $-C_2H_5$ | Cl | Cl |
| -4 | $-C(CH_3)_3$ | $-C_{15}H_{31}$ | Cl | Cl |
| -5 | 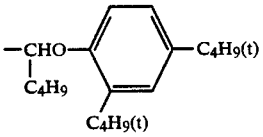 | $-C_2H_5$ | Cl | Cl |
| -6 | 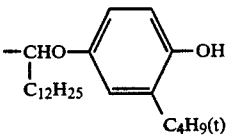 | $-CH_3$ | F | F |
| -7 | 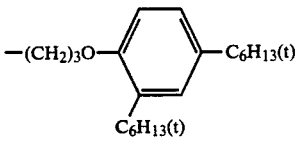 | $-C_2H_5$ | Cl | Cl |

-continued
Cyan coupler (C-II)
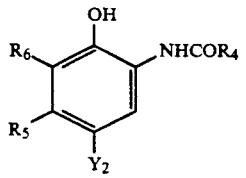
| Coupler C-II | $R_4$ | $R_5$ | $R_6$ | $Y_2$ |
|---|---|---|---|---|
| -8 | 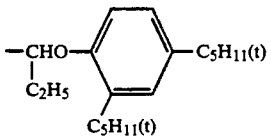 | $-CH_2NHCOCH_3$ | Cl | Cl |
| -9 | " | $-C_2H_5$ | $-NHCOCH_3$ | Cl |
| -10 | $-C_{15}H_{31}$ | $-C_2H_5$ | Cl | Cl |
| -11 | $-(CH_2)_2O(CH_2)_7CH_3$ | $-C_{15}H_{31}$ | Cl | Cl |
| -12 | $-(CH_2)_7O(CH_2)_7CH_3$ | $-C_2H_5$ | Cl | Cl |
| -13 | 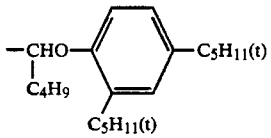 | $-CH_3$ | Cl | Cl |
| -14 | $-C_{15}H_{31}$ | $-CH_3$ | Cl | Cl |
Cyan coupler (C-III)
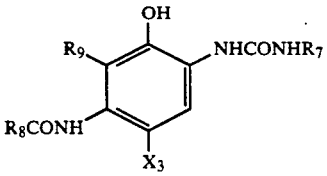
| No. | $R_9$ | $R_7$ | $R_8$ | $X_3$ |
|---|---|---|---|---|
| C-III | | | | |
| 1 | H | 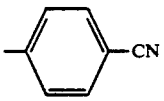 | 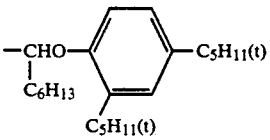 | 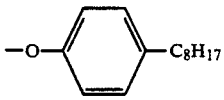 |
| 2 | H | 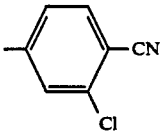 | 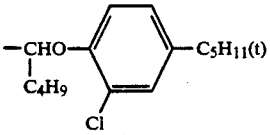 | Cl |
| 3 | H | 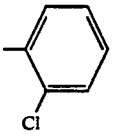 | 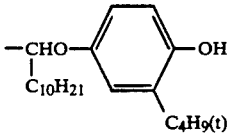 | $-O(CH_2)_2SCH_2COOH$ |

-continued
Cyan coupler (C-III)
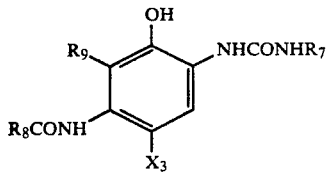
| No. | $R_9$ | $R_7$ | $R_8$ | $X_3$ |
|---|---|---|---|---|
| 4 | Cl | 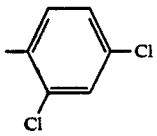 | 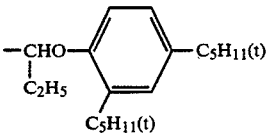 | $O(CH_2)_2SO_2CH_3$ |
| 5 | $CH_3$ | 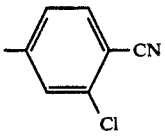 | 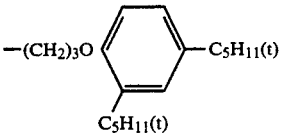 | $-OCH_2CONH(CH_2)_2OCH_3$ |
| 6 | H | 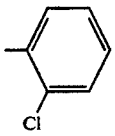 | 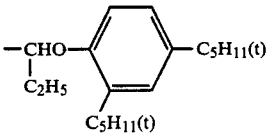 | 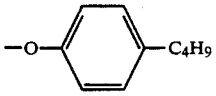 |
Cyan coupler (C-IV)
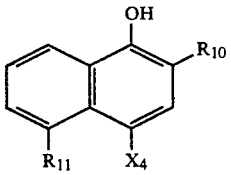
| No. | $R_{11}$ | $R_{10}$ | $X_4$ |
|---|---|---|---|
| C-IV | | | |
| 1 | H | $-CONHC_{16}H_{33}$ | Cl |
| 2 | H | $-CON(CH_2CH_2CN)(C_{16}H_{33})$ | Cl |
| 3 | H | $-CONHC_{12}H_{25}$ | $-O(CH_2)_2NHSO_2CH_3$ |
| 4 | H | 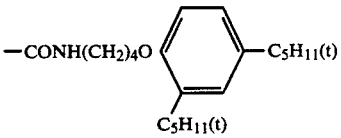 | $-O(CH_2)_2SCH_2COOH$ |
| 5 | H | $-CONHC_{16}H_{33}$ | $-O(CH_2)_2SO_2CH_3$ |
| 6 | H | 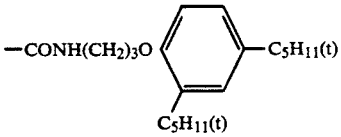 | " |
| 7 | H | $-CONHC_{16}H_{33}$ | $-O(CH_2)_2SCH_2COOH$ |

-continued

Cyan coupler (C-IV)

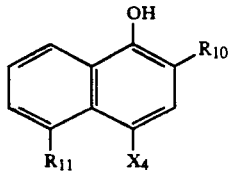

| No. | $R_{11}$ | $R_{10}$ | $X_4$ |
|---|---|---|---|
| 8 | $C_4H_9CONH-$ | $-CONHC_4H_9$ | $-O(CH_2)_2SCHC_{12}H_{25}$ (COOH) |
| 9 | " | $-CONH(CH_2)_3OC_{12}H_{25}$ | $-O(CH_2)_2SCH_2COOH$ |

Couplers capable of releasing a photographically useful residue upon coupling reaction with an oxidized color developing agent are also usable. DIR couplers (development inhibitor-releasing couplers) which release a development inhibitor include those described in Paragraph VII-F of RD 17643. Couplers which release a development accelerator are also usable. These are described in, for example, J.P. KOKAI Nos. 57-150845 and 60-128446. Couplers which release a fluorescent substance such as those described in U.S. Pat. No. 4,774,181 are also usable.

Two or more couplers can be contained in a photosensitive layer in order to obtain properties required of the photosensitive material or the same compound can be contained in two or more different layers according to the present invention.

The standard amount of the color coupler is 0.05 to 1 mol per mol of the photosensitive silver halide. It is preferably 0.1 to 0.5 mol (yellow coupler), 0.1 to 0.3 mol (magenta coupler) or 0.1 to 0.3 mol (cyan coupler).

These couplers can be dispersed in at least one high-boiling organic solvent to form a dispersion to be incorporated into an emulsion layer. The high-boiling organic solvents usable herein are those described in J.P. KOKAI No. 62-215272. Other high-boiling organic solvents include N,N-dialkylaniline derivatives. Among them, those having an alkoxy group at the o-position to the N,N-dialkylamino group are preferred. The use of the solvent is particularly preferred when the above-described coupler [M-1] or [M-2] is used. The amount of the solvent is usually 0.1 to 5 mol, preferably 0.2 to 3 mol, per mol of the coupler.

A loadable latex polymer (see, for example, U.S. Pat. No. 4,203,716) can be impregnated with the coupler in the presence or absence of the above-described high-boiling organic solvent or, alternatively, the coupler can be dissolved in a water-insoluble, organic solvent-soluble polymer and then be emulsion-dispersed in an aqueous solution of a hydrophilic colloid. Homopolymers or copolymers described on pages 12 to 30 of International Patent Publication No. WO88/-00723 are preferably used. The use of acrylamide polymers is particularly preferred from the viewpoint of the stabilization of the color image.

The photosensitive material used in the present invention may contain a color antifoggant such as a hydroquinone derivative, aminophenol derivative, gallic acid derivative or ascorbic acid derivative.

The photosensitive material used in the present invention may contain various fading inhibitors. Typical examples of organic decoloration inhibitors for the cyan, magenta and/or yellow images include hindered phenols such as hydroquinones, 6-hydroxychromans, 5-hydroxycoumarans, spirochromans, p-alkoxyphenols and bisphenols; gallic acid derivatives, methylenedioxybenzenes, aminophenols, hindered amines and ether or ester derivatives of these obtained by silylating or alkylating the phenolic hydroxyl group thereof. Further metal complexes such as (bissalicylaldoxymato)nickel complexes and (bis-N,N-dialkyldithiocarbamato)nickel complexes are also usable.

Examples of the organic fading inhibitors are described in the following publications:

The hydroquinones are described in U.S. Pat. Nos. 2,360,290, 2,418,613, 2,700,453, 2,701,197, 2,728,659, 2,732,300, 2,735,765, 3,982,944 and 4,430,425, British Patent No. 1,363,921 and U.S. Pat. Nos. 2,710,801 and 2,816,028. 6-Hydroxychromans, 5-hydroxycoumarans and spirochromans are described in U.S. Pat. Nos. 3,432,300, 3,573,050, 3,574,627, 3,698,909 and 3,764,337 and J.P. KOKAI No. 52-152225. The spiroindanes are described in U.S. Pat. No. 4,360,589. The p-alkoxyphenols are described in U.S. Pat. No. 2,735,756, British Patent No. 2,066,975, J.P. KOKAI No. 59-10539 and J.P. KOKOKU No. 57-19765. The hindered phenols are described in U.S. Pat. No. 3,700,455, J.P. KOKAI No. 52-72224, U.S. Pat. No. 4,228,235 and J.P. KOKOKU No. 52-6623. The gallic acid derivatives, meth ylenedioxybenzenes and aminophenols are described in U.S. Pat. Nos. 3,457,079 and 4,332,886 and J.P. KOKOKU No. 56-21144, respectively. The hindered amines are described in U.S. Pat. Nos. 3,336,135 and 4,268,593, British Patent Nos. 1,326,889, 1,354,313 and 1,410,846, J.P. KOKOKU No. 51-1420, and J.P. KOKAI Nos. 58-114036, 59-53846 and 59-78344. The ether and ester derivatives of the phenolic hydroxyl group are described in U.S. Pat. Nos. 4,155,765, 4,174,220, 4,254,216 and 4,264,720, J.P. KOKAI Nos. 54-145530, 55-6321, 58-105147 and 59-10539, J.P. KOKOKU No. 57-37856, U.S. Pat. No. 4,279,990 and J.P. KOKOKU No. 53-3263. The metal complexes are described in U.S. Pat. Nos. 4,050,938 and 4,241,155, and British Patent No. 2,027,731 (A). Usually 5 to 100% by weight, based on the corresponding color coupler, of these compounds are emulsified together with the coupler and incorporated into the photosensitive layer to attain the object. To prevent deterioration of the cyan dye image caused by heat or, particularly, light, it is effective to introduce an U.V. absorber into the cyan dye layer and layers on both sides of this layer.

Among the above-described fading inhibitors, the spiroindanes and hindered amines are particularly preferred.

In the present invention, it is preferred to use compounds which will be described below together with the above-described couplers, particularly pyrazoloazole couplers.

When the following compound (F) and/or (G) is used, stains due to a developed dye formed by the reaction of the residual color developing agent or its oxidation product in the emulsion with the coupler or other side reactions are inhibited:

Compound (F): a compound capable of reacting with an aromatic amine developing agent remaining after the color development process to form a chemically inert, substantially colorless compound, and Compound (G): a compound capable of reacting with an oxidation product of an aromatic amine developing agent remaining after the color developing process to form a chemically inert, substantially colorless compound.

Preferred compounds (F) are those having a second-order reaction velocity constant k2 (in trioctyl phosphate at 80° C.) of 1.0 l/mol·sec to $1\times10^{-3}$ l/mol·sec. The second-order reaction velocity constant can be determined by a method described in J.P. KOKAI No. 63-15845.

When the value of k2 exceeds this range, the compound per se is unstable and is decomposed by reaction with gelatin or water. On the contrary, when the value of k2 is lower than this range, the reaction velocity of the compound with the remaining aromatic amine developing agent is low, making the inhibition of the side effect of the remaining aromatic amine developing agent impossible.

More preferred examples of the compounds (F) are those of the following general formula (FI) or (FII):

$$R_1\text{-}(A)_n\text{-}X \qquad \text{(F1)}$$

$$R_2\text{—}\underset{\underset{B}{|}}{C}\text{=}Y \qquad \text{(F2)}$$

wherein $R_1$ and $R_2$ each represent an aliphatic group, aromatic group or heterocyclic group, n represents 1 or 0, A represents a group capable of reacting with an aromatic amine developing agent to form a chemical bond, X represents a group which splits off upon reaction with an aromatic amine developing agent, B represents a hydrogen atom, aliphatic group, aromatic group, heterocyclic group, acyl group or sulfonyl group, Y represents a group capable of accelerating the addition of the aromatic amine developing agent to a compound of the general formula (F-II), and $R_1$ and X, or Y and $R_2$ or B may be bonded together to form a cyclic structure.

The chemical reaction with the remaining aromatic amine developing agent is conducted mainly by substitution reaction or addition reaction.

Preferred examples of the compounds of the general formulae (F I) and (F II) include those described in J.P. KOKAI Nos. 63-158545 and 62-283338 and Japanese Patent Application Nos. 62-158342 and 63-18439.

Preferred examples of the compounds (G) capable of reacting with the oxidation product of the aromatic amine developing agent remaining after the color developing process to form a chemically inert, substantially colorless compound are those of the following general formula (G I):

$$R\text{-}Z \qquad \text{(G I)}$$

wherein R represents an aliphatic group, aromatic group or heterocyclic group and Z represents a nucleophilic group or a group capable of releasing a nucleophilic group by decomposition in the photosensitive material.

Z in the compound of the general formula (G I) is preferably a group having a Pearson's nucleophilic $^{n}CH_3I$ value [R. G. Pearson et al., J. Am. Chem. Soc., 90: 319 (1968)] of at least 5 or a group derived therefrom.

Preferred examples of the compounds of the general formula (G I) are described in European Patent Publication No. 255,722, J.P. KOKAI Nos. 62-143048 and 62-229145, and Japanese Patent Application Nos. 63-18439, 63-136724, 62-214681 and 62-158342.

The details of the combination of the compounds (G) and (F) are described in J.P. Application No. 63-18439.

The hydrophilic colloid layer of the photosensitive material used in the present invention may contain water-soluble dyes as a filter dye or for the purpose of inhibition of irradiation. These dyes include oxonol dyes, hemioxonol dyes, styryl dyes, merocyanine dyes and azo dyes. Among them, the oxonol dyes, hemioxonol dyes and merocyanine dyes are useful.

Gelatin is advantageously used as the binder or protective colloid in the emulsion layer of the photosensitive material according to the present invention. Other hydrophilic colloids can also be used singly or in combination with gelatin.

The gelatin used in the present invention is treated with either lime or an acid. The details of a method of preparing gelatin are described in Arthur Veis 'The Macromolecular Chemistry of Gelatin' (published by Academic Press in 1964).

As the silver halide contained in the emulsion of the present invention, silver chlorobromide or silver chloroiodobromide having a silver chloride content of at least 90 molar % can be advantageously used. The silver chloride content is preferably 90 to 99.9%, more preferably 95 to 99.8%.

The silver iodide content of the silver chloroiodobromide used in the present invention is at most 3 molar %, preferably at most 1 molar % and more preferably at most 0.5 molar %, based on the total silver halides. In the case where the silver bromide content or the silver iodide content of the silver chlorobromide and the silver chloroiodobromide increases over the upper limit defined by the present invention, the objects of the present invention cannot be accomplished, unclear color increases and color reproducibility declines.

The photosensitive material used in the present invention has at least one layer comprising the silver halide emulsion and the above-described coupler. This layer is preferably the bottom emulsion layer and more preferably all of BL, GL and RL.

The silver halide grains in the photographic emulsion may be in a regular crystal form such as cubic, octahedral or tetradecahedral; an irregular crystal form such as spherical or plate; or a complex crystal form thereof.

The silver halide grain diameter ranges from less than about 0.2 μm to a diameter of a projected surface area of about 10 μm. The emulsion may be either a polydisperse or monodisperse emulsion.

The silver halide photographic emulsion usable in the present invention can be prepared by processes described in, for example, Research Disclosure (RD), No. 17643 (December, 1978), pages 22 and 23, 'I. Emulsion preparation and types', RD No. 18716 (November, 1976), page 648, p. Glafkides, 'Chemic et Phisique Photographique' published by Paul Montel in 1967, G. F. Duffin, 'Photographic Emulsion Chemistry' published by Focal Press in 1966, and V. L. Zelikman et al. 'Making and Coating Photographic Emulsion' published by Focal Press in 1964.

Monodisperse emulsions described in U.S. Pat. Nos. 3,574,628 and 3,655,394 and British Patent No. 1,413,748 are also preferred.

Tabular grains having an aspect ratio of about 5 or higher are also usable in the present invention. The tabular grains can be easily prepared by methods described in Gutoff, 'Photographic Science and Engineering', Vol. 14, pages 248 to 257 (1970); U.S. Pat. Nos. 4,434,226, 4,414,310, 4,433,048 and 4,439,520 and British Patent No. 2,112,157.

The crystal structure may be various. The crystals may be homogeneous, may comprise a core and a shell having different halogen composition, or may have a layered structure. Silver halides having different compositions may be joined together by epitaxial bond. The silver halide may also be joined with a compound other than the silver halide such as silver rhodanide or lead oxide. Further a mixture of grains having various crystal forms can also be used.

The silver halide emulsion is usually physically or chemically aged and spectrally sensitized before use. Additives used in these steps are described in Research Disclosure Nos. 17643 and 18716. The portions of the description in these reports are summarized in a table below.

The amount of silver chloride to be applied is preferably 0.8 g/m$^2$ or less, more preferably 0.75 g/m$^2$ or less. It is preferably contained in an amount of 0.05 to 0.5 g/m$^2$, more preferably 0.10 to 0.45 g/m$^2$ in each of BL, GL and RL layers. Silver chloride in an amount larger than a certain amount is necessitated for obtaining a sufficient $D_{max}$. When the development and fixing are conducted in only one bath, the application of silver chloride in an excess amount is unsuitable for forming an excellent image with clear colors.

Known photogrpahic additives usable in the present invention are also disclosed in the above-described two books of Research Disclosure. The portions of the description are summarized in the following Table.

| Additive | RD 17643 | RD 18716 |
|---|---|---|
| 1 Chemical sensitizer | p. 23 | right column, p. 648 |
| 2 Sensitivity improver | | right column, p. 648 |
| 3 Spectral sensitizer Supersensitizer | pp. 23 and 24 | right column, p. 648 to right column, p. 649 |
| 4 Brightener | p. 24 | |
| 5 Antifoggant and stabilizer | pp. 24 and 25 | right column, p. 649 |
| 6 Light absorber, filter dye and U.V. absorber | pp. 25 and 26 | right column, p. 649 to left column, p. 650 |

-continued

| Additive | RD 17643 | RD 18716 |
|---|---|---|
| 7 Antistaining agent | right column, p. 25 | left and right columns, p. 650 |
| 8 Dye image stabilizer | p. 25 | |
| 9 Hardener | p. 26 | left column, p. 651 |
| 10 Binder | p. 26 | left column, p. 651 |
| 11 Plasticizer and lubricant | p. 27 | right column, p. 650 |
| 12 Coating assistant and surfactant | pp. 26 and 27 | right column, p. 650 |
| 13 Antistatic agent | p. 27 | right column, p. 650 |

The supports usable in the present invention are those usually used for the photosensitive materials such as cellulose nitrate film, cellulose acetate film, cellulose acetate butyrate film, cellulose acetate propionate film, polystyrene film, polyethylene terephthalate film, polycarbonate film, a laminate of two or more of these, thin glass film and paper. Excellent results are obtained when a baryta paper, a paper coated or laminated with an α-olefin polymer having preferably 2 to 10 carbon atoms such as polyethylene, polypropylene or ethylene/butene copolymer, or a plastic film having the surface roughened so as to improve the adhesion thereof to another polymeric substance as described in J.P. KOKOKU No. 47-19068 is used. Further U.V. raycurable resins are also usable.

Either transparent or opaque support is used depending on the use of the photosensitive material. By adding a dye or pigment, the colored, transparent support can be produced.

The opaque supports include essentially opaque ones such as a paper, those prepared by incorporating a dye or a pigment such as titanium oxide into transparent films, plastic films surface-treated by a method described in J.P. KOKAI No. 47-19068 and completely light-shielding paper or plastic films containing carbon black, a dye or the like. To further improve the adhesion, the surface of the support can be pre-treated by corona discharge, irradiation with U.V. rays or treatment with a flame.

The term "reflecting support" herein indicates a support having reflecting properties increased in order to make the dye image formed on the silver halide emulsion layer clearer. The reflecting supports include the supports coated with a hydrophobic resin containing a light-reflecting substance such as titanium oxide, zinc oxide, calcium carbonate or calcium sulfate dispersed therein and supports made of a hydrophobic resin containing the light-reflecting substance dispersed therein. They include, for example, baryta paper, polyethylene-coated paper, synthetic polypropylene paper, transparent supports having a reflecting layer or combined with a reflecting substance, such as a glass plate, a polyester film, e.g. polyethylene terephthalate, cellulose triacetate or celulose nitrate film, polyamide film, polycarbonate film, polystyrene film and vinyl chloride resin film. They are suitably selected depending on the use of the film.

The light-reflecting substances are preferably thoroughly kneaded with a white pigment in the presence of a surfactant. The surface of the pigment grains is preferably treated with a dihydric, trihydric or tetrahydric alcohol.

The ratio of area (%) occupied by the fine white pigment grains to a predetermined unit area can be determined most typically by dividing the observation area into 6 μm×6 μm unit areas and determining the ratio of the area (%) ($R_1$) occupied by the fine particles projected thereon to the unit area. The coefficient of variation of the occupied area ratio (%) is determined from the ratio of the standard deviations of $R_1$ to the average value ($\bar{R}$) of $R_1$, i.e. $s/\bar{R}$. The number of the unit areas (n) is preferably at least 6. Therefore, the coefficient of variation s/R can be determined from the following formula:

$$\sqrt{\frac{\sum_{i=1}^{n}(Ri)-\bar{R})^2}{n-1}} \Big/ \frac{\sum_{i=1}^{n} Ri}{n}$$

The coefficient of variation of the area occupied by the fine pigment grains (%) herein is preferably 0.15 or less, particularly 0.12 or less. When it is 0.08 or less, the grains are substantially 'homogeneously' dispersed.

Now description will be made on the processing method and solutions used therein according to the present invention.

A typical process of the present invention comprises the following steps:

(1) Color development/fixing-stabilization-drying,
(2) Color development/fixing-washing with water-stabilization-drying
(3) Color development/fixing-washing with water-drying.

In the color development/fixing step, the silver halide photosensitive material containing the color coupler is color-developed in the presence of a color developing agent and the silver halide is removed from the photosensitive material by dissolution.

To stably conduct the process, intensification with an assistant such as hydrogen peroxide or a copper compound is preferred.

Aromatic primary amine compounds of the following general formula (A) are used as the color developing agent:

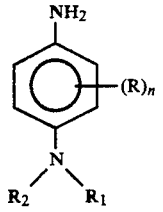

(A)

wherein R represents a hydrogen atom, halogen atom, cyano group, hydroxy group, alkyl group, amino group, alkoxy group, aryloxy group, acylamino group, sulfonamino group, alkoxycarbonylamino group, aminocarbonylamino group, sulfonyl group, carbamoyl group, sulfamoyl group, alkoxycarbonyl group, acyl group, acyloxy group, sulfo group or carboxyl group which may be unsubstituted or substituted, n represents an integer of 1 to 4 and when n is 2 or above, R's may be either the same or different, and $R_1$ and $R_2$ each represent an unsubstituted or substituted alkyl group having 12 or less carbon atoms, $R_1$ and $R_2$ may be bonded together to form a heterocyclic ring or $R_1$ or $R_2$ may be bonded with R to form a ring structure.

The substituents may be any substituents for the alkyl group. They include, for example, a hydroxy group, amino group, alkoxy group, aminocarbonyloxy group, aralkoxycarbonyl group, sulfonylamino group, sulfocarboxyl group, acyloxy group, alkoxycarbonyloxy group, acylamino group, cyano group, sulfonic acid group and halogen atoms.

Although the aromatic primary amine color developing agent of the general formula (A) can be used as the free base, it is usually used in the form of a salt with an organic or inorganic acid. The organic acids include, for example, oxalic acid, methanesulfonic acid, benzenesulfonic acid, p-toluenesulfonic acid and naphthalenesulfonic acid. The inorganic acids include, for example, hydrochloric acid, sulfuric acid, phosphoric acid and perchloric acid.

Examples of the aromatic primary amine color developing agents of the above general formula (A) include the following compounds, which by no means limit the present invention:

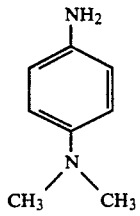

(A-1)

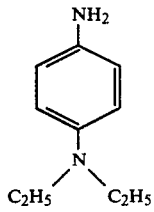

(A-2)

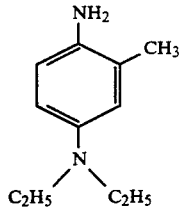

(A-3)

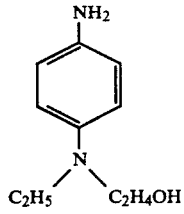

(A-4)

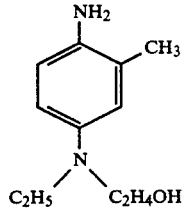

(A-5)

-continued
(A-6)
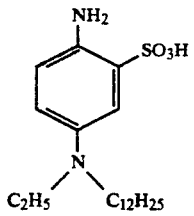
(A-7)
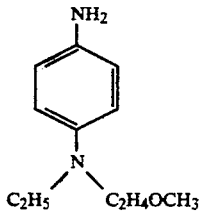
(A-8)
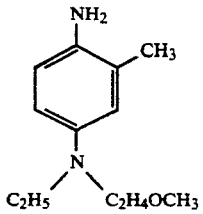
(A-9)
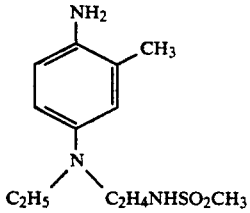
(A-10)
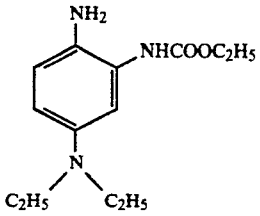
(A-11)
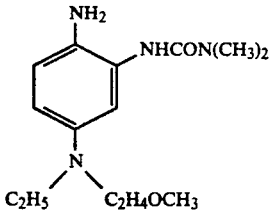
(A-12)
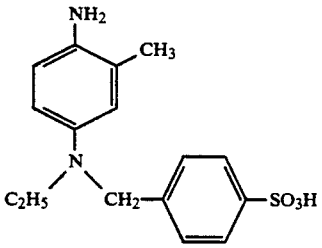
-continued
(A-13)
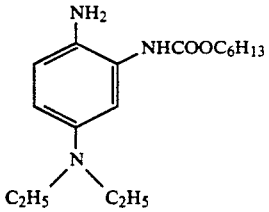
(A-14)
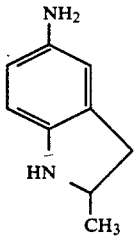
(A-15)
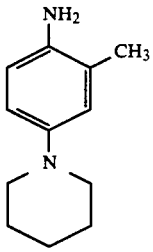
(A-16)
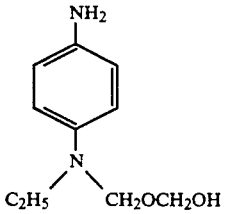
(A-17)
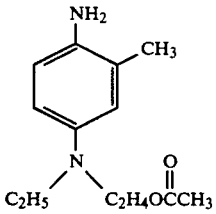
(A-18)
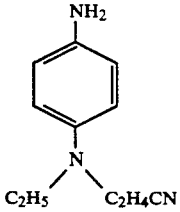
(A-19)
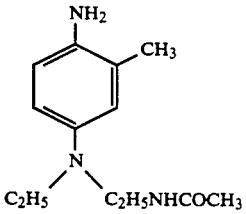

-continued (A-20)

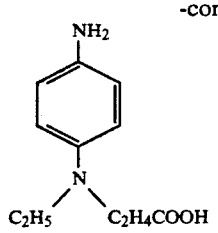

(A-21)

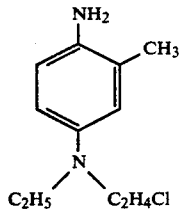

(A-22)

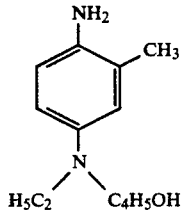

(A-23)

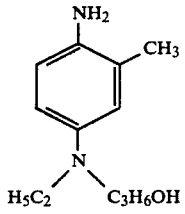

(A-24)

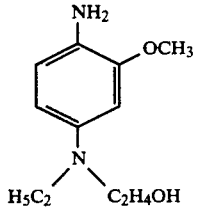

The color developing agent can be incorporated into both the processing solution and the photosensitive material. Although one kind of color developing agent is usually used, a combination of two or more can be used in order to accelerate the rapid processing or to modify the photographic properties such as sensitivity and gradation.

When the color developing agent is incorporated into the processing solution, the amount thereof is usually in the range of 0.005 to 0.05 mol per liter of the solution.

When the color developing agent is incorporated into the photosensitive material, the amount thereof is 0.1 to 10 mol, preferably 0.25 to 5 mol, per mol of total silver content of the photosensitive material per a unit area. The color developing agent is preferably in the form of its precursor which releases the agent in the presence of an alkali solution. The precursors are described in, for example, U.S. Pat. No. 3,342,599 (a Schiff base with salicyl aldehyde is used as precursor of the developing agent), U.S. Pat. No. 3,719,492 (the color developing agent is used in combination with a metal salt such as lead or cadmium salt), British Patent No. 1,069,061 (an aromatic primary amine and phthalic acid are reacted to form a phthalimide-type precursor), German Patent Nos. 1,159,758 and 1,200,679 and U.S. Pat. No. 3,705,035. It is also preferred that the color developing agent is made in the form of its borofluoride or phosphofluoride as described in J.P. KOKOKU No. 63-62732. The amount of the precursor of the color developing agent used in the application step is 0.1 to 10 mol, preferably 0.25 to 5 mol, per mol of total silver in the photosensitive material in the unit area. The precursor of the color developing agent can be incorporated into the silver halide emulsion-containing photosensitive layer or other layers (such as intermediate layer, the developing agent-containing layer, protective layer and primer layer).

Although these compounds can be incorporated into any layers of the photosensitive material, they are preferably incorporated not into the silver halide emulsion layer but into layers adjacent thereto in order to inhibit fogging during storage of the photosensitive material.

The processing solution used for the color development/fixing (hereinafter referred to as color development/fixing solution) is an alkaline solution having a buffereing effect. The alkalis include alkali metal carbonates such as potassium carbonate, sodium carbonate, lithium carbonate, potassium hydrogencarbonate and sodium hydrogencarbonate; alkali metal phosphates such as potassium tertiary phosphate, potassium hydrogenphosphate, sodium tertiary phosphate and sodium hydrogenphosphate; alkali metal borates such as sodium metaborate; and alkali metal hydroxides such as potassium hydroxide, sodium hydroxide and lithium hydroxide. The pH of the alkaline processing solution is usually in the range of 9 to 13. In order to accelerate the development, to improve the color development of the coupler and to secure the inhibition of fogging and stability of the properties of the processing solution, the pH is preferably 9.5 to 12, particularly 10 to 11.5.

The color development/fixing solution used in the present invention comprises the above-described developing agent and a solvent for the silver halide. The solvents include, for example, alkali metal thiosulfates such as sodium thiosulfate, potassium thiosulfate, ammonium thiosulfate and lithium thiosulfate; alkali metal sulfites such as potassium sulfite; alkali metal thiocyanates such as potassium thiocyanate; thiourea and its derivatives such as ethylenethiourea; mercapto compounds such as thioglycolic acid, thiosalicyclic acid, cysteine and p-mercaptobenzoic acid; and thioether compounds described in U.S. Pat. No. 3,201,242 such as 3,6-dithia-1,8-octanediol. Among them, the thiosulfates and thioether compounds such as 3,6-dithia-1,8-octanediol are preferred and particularly thiosulfates are preferred, since they have a suitable silver halide-dissolving velocity well-balanced with the development velocity.

The amount of the solvent for the silver halide in the color development/fixing solution is not particularly limited so far as the object of the present invention is not hindered. Usually, however, it varies depending on the kind and amount of the developing agent, the pH and temperature of the processing solution and other processing conditions. When it is in excess, even the silver halide to be developed is removed to impair the coloring properties and, on the contrary, when it is insufficient, a sufficient fixing power cannot be obtained, the removal of the undeveloped silver halide is insufficient and fogging is caused. Thus the amount of this solvent is in the range of 0.001 to 1 mol/l, preferably 0.005 to 0.7 mol/l and particularly 0.01 to 0.5 mol/l.

When the color development/fixing solution contains the color developing agent, it is preferred to incorporate also a preservative for the color developing agent into the solution. The preservatives usable here include hydroxylamines and diethylhydroxylamines. Examples include hydroxylamines of the general formula (I) given below, hydroxamic acids of the general formula (II) and hydrazine, hydrazides and triethanolamines of the general formula (III). Further monoamines and sulfites of the general formula (VII) are usuable. Among them, substituted hydroxylaminines and carboxymethylhydrazines having a low silver-developing activity and only a slight coloring inhibition are preferred.

The amount of the compounds described below to be added to the color development/fixing solution is 0.005 to 0.5 mol/l, preferably 0.03 to 0.1 mol/l.

Preferred hydroxyamine derivatives are as follows: Compounds of the following general formula (I):

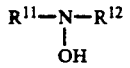

wherein $R^{11}$ and $R^{12}$ each represent a hydrogen atom, unsubstituted or substituted alkyl group, unsubstituted or substituted alkenyl group, unsubstituted or substituted aryl group or heterocyclic aromatic group or $R^{11}$ and $R^{12}$ may be connected together to form a heterocyclic ring with the nitrogen atom, the heterocycle is five- or six-membered, saturated or unsaturated ring comprising carbon, hydrogen, halogen, oxygen, nitrogen and sulfur atoms, etc.

$R^{11}$ and $R^{12}$ are preferably an alkyl or alkenyl group having 1 to 10, particularly 1 to 5 carbon atoms. The nitrogen-contnaining heterocyclic ring formed by $R^{11}$ and $R^{12}$ connected together is a piperidyl, pyrrolidyl, N-alkyl-pererazyl, morpholinyl, indolinyl or benzotriazolyl group or the like.

Preferred substituents of $R^{11}$ and $R^{12}$ include a hydroxyl, alkoxy, alkylsulfonyl, arylsulfonyl, amido, carboxy, cyano, sulfo, nitro and amino groups.

Examples of the compounds are as follows:

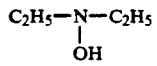
I-1

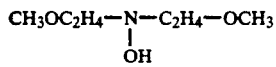
I-2

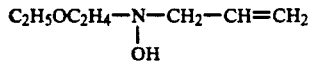
I-3

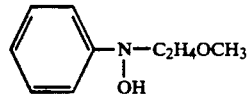
I-4

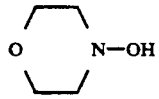
I-5

-continued

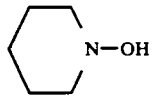
I-6

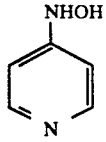
I-7

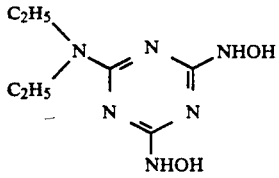
I-8

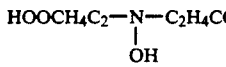
I-9

I-10

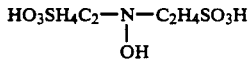
I-11

Preferred hydroxamic acids are those of the general formula (II):

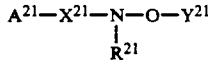
(II)

In the above general formula (II), $A^{21}$ represents a hydrogen atom, substituted or unsubstituted alkyl group, substituted or unsubstituted aryl group, substituted or unsubstituted amino group, substituted or unsubstituted heterocyclic group, substituted or unsubstituted alkoxy group, substituted or unsubstituted aryloxy group, substituted or unsubstituted carbamoyl group, substituted or unsubstituted sulfamoyl group, acyl group, carboxy group, hydroxyamino group or hydroxyaminocarbonyl group. The substituents include, for example, halogen atoms, aryl groups, alkyl groups and alkoxy groups.

$A^{21}$ is preferably a substituted or unsubstituted alkyl group, aryl group, amino group, alkoxy group or aryloxy group. $A^{21}$ is particularly preferably a substituted or unsubstituted amino group, alkoxy group or aryloxy group having preferably 1 to 10 carbon atoms.

$X^{21}$ in the above general formula (II) represents

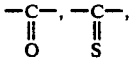

$—SO_2—$ or —SO—. Among them,

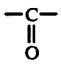

is preferred.

$R^{21}$ in the above general formula (II) represents a hydrogen atom, substituted or unsubstituted alkyl group or substituted or unsubstituted aryl group. $A^{21}$ may be connected with $R^{21}$ to form a ring structure.

The substituents are the same as those described above for $A^{21}$. $R^{21}$ is preferably a hydrogen atom.

$Y^{21}$ represents a hydrogen atom or a group capable of being changed into hydrogen atom by hydrolysis reaction.

II-1

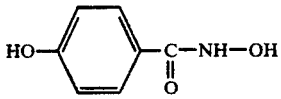

II-2

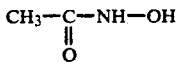

II-3

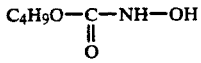

II-4

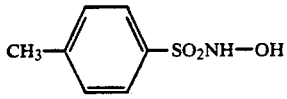

II-5

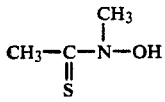

II-6

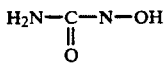

Preferred hydrazines and hydrazides are those of the following general formula (III):

(III)

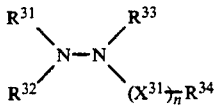

wherein $R^{31}$, $R^{32}$ and $R^{33}$ each represents a hydrogen atom, or a substituted or unsubstituted alkyl group, aryl group or heterocyclic group, $R^{34}$ represents a hydroxyl group, hydroxyamino group, or substituted or unsubstituted alkyl, aryl, heterocyclic, alkoxy, aryloxy, carbamoyl or amino group, the heterocyclic group which may be either saturated or unsaturated has a five-membered or six-membered ring and comprises C, H, O, N, S, halogen atoms, etc, $X^{31}$ represents a divalent group selected from among —CO—, —$SO_2$— and

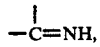

and n represents 0 or 1, and when n is 0, $R^{34}$ represents a group selected from among alkyl, aryl and heterocyclic groups, or $R^{33}$ and $R^{34}$ may be connected together to form a heterocyclic ring.

$R^{31}$, $R^{32}$ and $R^{33}$ in the general formula (III) are each preferably a hydrogen atom or an alkyl group having 1 to 10 carbon atoms. Particularly $R^{31}$ and $R^{32}$ are each most preferably a hydrogen atom.

$R^{34}$ in the general formula (III) is preferably an alkyl, aryl, alkoxy, carbamoyl or amino group. In particular, $R^{34}$ is most preferably an alkyl or substituted alkyl group. The substituents for the alkyl group are preferably carboxyl, sulfo, nitro, amino and phosphono groups.

Preferably $X^{31}$ is —CO— or —$SO_2$—. Most preferably $X^{31}$ is —CO—.

(III-1)

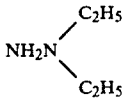

(III-2) $NH_2NH(CH_2)_4SO_3H$ (III-3) $NH_2NH(CH_2)_2OH$ (III-4)

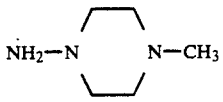

(III-5)

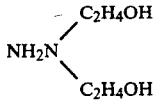

(III-6) $NH_2NHCOCH_3$ ((III-7) $NH_2NHCOOC_2H_5$ (III-8)

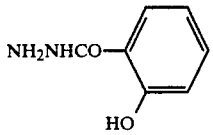

(III-9)

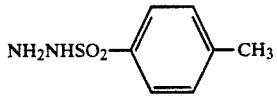

(III-10) $NH_2NHCONH_2$ (III-11)

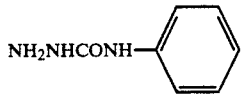

(III-12) $NH_2NHSO_3H$ (III-13)

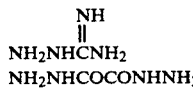

(III-14) $NH_2NHCOCONHNH_2$ (III-15) $NH_2NHCH_2CH_2CH_2SO_3H$ (III-16)

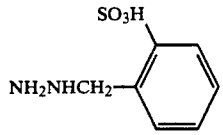

(III-17)

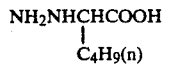

(III-18) $NH_2NHCH_2CH_2COOH$ (III-19)

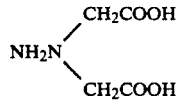

(III-20)

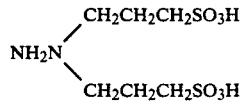

-continued (III-21)

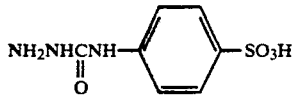

(III-22)

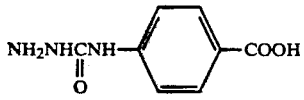

The monoaminines include the compounds of the following general formula (VII)

(VII)

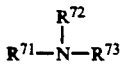

wherein $R^{71}$, $R^{72}$ and $R^{73}$ each represent a hydrogen atom, alkyl group, alkenyl group, aryl group, aralkyl group or heterocyclic group, or $R^{71}$ and $R^{72}$, $R^{71}$ and $R^{73}$, or $R^{72}$ and $R^{73}$ may be connected together to form a nitroagen-containing heterocyclic ring, and $R^{71}$, $R^{72}$ and $R^{73}$ may be substituted.

$R^{71}$, $R^{72}$ and $R^{73}$ are each preferably a hydrogen atom or alkyl gorup. The substituents include, for example, hydroxyl group, sulfonic acid group, carboxyl group, halogen atom, nitro group and amino group.

$N(CH_2CH_2OH)_3$ VII-1

$H_2NCH_2CH_2OH$ VII-2

$HN(CH_2CH_2OH)_2$ VII-3

VII-4

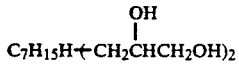

VII-5

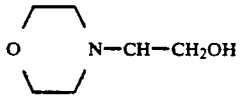

VII-6

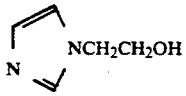

VII-7

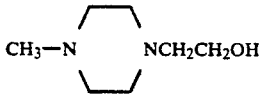

VII-8

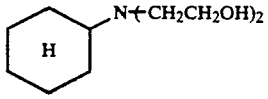

VII-9

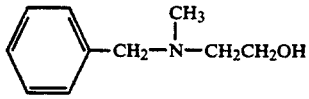

$(HOCH_2CH_2)_2NCH_2CH_2SO_2CH_3$ VII-10

$HN(CH_2COOH)_2$ VII-11

$HOOCCH_2CH_2CHCOOH$ VII-12
$\quad\quad\quad

The amount of the chelating agent is such that is enough for deactivating metal ions in the color developing solution. It is, for example, about 0.1 to 10 g/l. A development accelerator can be added to the color developing solution.

The development accelerators include, for example, thioether compounds described in J.P. KOKOKU Nos. 37-16088, 37-5987, 38-7826, 44-12380 and 45-9019 and U.S. Pat. No. 3,813,247; p-phenylenediamine compounds described in J.P. KOKAI Nos. 52-49829 and 50-15554; quaternary ammonium salts described in J.P. KOKAI No. 50-137726, J.P. KOKOKU No. 44-30074 and J.P. KOKAI Nos. 56-156826 and 52-43429; p-aminophenols described in U.S. Pat. Nos. 2,610,122 and 4,119,462; amine compounds described in U.S. Pat. Nos. 2,494,903, 3,128,182, 4,230,796 and 3,253,919, J.P. KOKOKU No. 41-11431, and U.S. Pat. Nos. 2,482,546, 2,596,926 and 3,582,346; polyalkylene oxides described in J.P. KOKOKU Nos. 37-16088 and 42-25201, U.S. Pat. No. 3,128,183, J.P. KOKOKU No. 41-11431 and 42-23883 and U.S. Pat. No. 3,532,501; and 1-phenyl-3-pyrazolidones, hydrazines, isoionic compounds, ionic compounds and imidazoles. They are used, if necessary.

The color development/fixing solution may contain an antifoggant, if necessary. The antifoggant is suitably selected depending on the kind of the photosensitive material (such as the kind of silver halide, e.g. silver chlorobromide or silver chloroiodobromide), developing agent, solvent for the silver halide, temperature and pH. Antifoggants usable over a wide range are alkali metal chlorides and bromides such as sodium chloride, potassium chloride, potassium bromide and sodium bromide; and benzimidazoles and benzotriazoles. The organic antifoggants include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine and adenine.

The color development-fixing agent used in the present invention preferably contains a fluorescent brightening agent. The fluorescent brightening agent is preferably a 4,4'-diamino-2,2'-disulfostilbene compound. It is used in an amount of 0 to 5 g/l, preferably 0.1 to 4 g/l.

If necessary, a surfactant such as an alkylsulfonic acid, arylphosphonic acid, aliphatic carboxylic acid or aromatic carboxylic acid may be added to the photosensitive material.

The temperature in the color development/fixing process is 25° to 60° C. For obtaining stable properties, the temperature is preferably 30° to 50° C., particularly 35° to 45° C.

After the color development/fixing process, the photosensitive material is washed with water or stabilized. The washing with water is conducted in order to wash out components from the photosensitive material and the stabilization is conducted to stabilize the image which cannot be conducted by washing with water. The washing with water or stabilization is usually conducted by immersing the photosensitive material in one or more tanks containing water for washing or a stabilizing solution. Methods of washing with water and stabilization described in, for example, J.P. KOKAI Nos. 57-8543 and 57-58143 are employed.

Other methods can also be employed. These include a method wherein a compact device such as a slit processing vessel is used as described in J.P. KOKAI Nos. 63-216050 and 63-235939 and a simplified method wherein water for washing or the stabilizing solution is applied to or sprayed on the photosensitive material and then wiped off with a web.

As described in J.P. KOKAI No. 60-260952, water for washing may contain a sterilizer, mildew-proofing agent, chelating agent, pH buffering agent and fluorescent brightener. The stabilizing solution may further contain a known image-stabilizer such as an ammonium compound, mercapto compound or amine.

The stabilization is conducted preferably at a high temperature such as 30° to 60° C., particularly 35° to 50° C., in order to accelerate the stabilization.

Water used for the washing or stabilization is deionized with an ion exchange resin in order to impart antiseptic properties to the photosensitive material or to prevent staining thereof as described in J.P. KOKAI No. 62-288838.

Now, the process according to the present invention will be described.

The silver bleaching step can be omitted in the present invention. The processing steps are greatly simplified. Therefore, a very small processor such as a compact, desk processor suffices. The color processing is thus simplified.

Another advantage is that since the color coupler has a high dye-covering power, the amount of silver to be applied can be remarkably reduced and also the color developing agent and the solvent for the silver halide can be saved and, as a result, only a very small amount of the processing solution suffices.

Therefore, the processing method is not limited to the immersion of the photosensitive material in the processing solution. Other excellent processing methods which can be employed in the present invention are, for example, a method wherein the processing solution is applied to the surface of the photosensitive material as described in U.S. Pat. Nos. 3,574,618 and 3,615,482 and a method wherein the processing solution is sprayed onto the surface of the photosensitive material as described in British Patent No. 1,352,062 and J.P. KOKAI No. 62-92936. Another preferred processing method comprises passing the photosensitive material through a small amount of the processing solution kept in a slit-type processing part as described in J.P. KOKAI No. 63-235939.

The photosensitive material used in the present invention may be either a color paper having a reflective support or a color film having a light-transmitting support.

The photosensitive material can be used for preparing an ordinary color print, color lay-out proof for the printing and also substances for easily forming a color film in situ such as color copies and computer graphics.

EXAMPLES

The following Examples will further illustrate the present invention, which by no means limit the invention.

The developing machine used in the following Examples is shown in FIG. 1. A processing tank 2 comprises a processing housing 4 having a lid 8 having a tandem-type top 6 hanging therein to form a slit-type processing passageway 15. The lid 8 has a handle 10. The top 6 is composed of substantially vertical, top-forming vinyl chloride material 12 having a rectangular cross section. At the top and the bottom of the parts 12 are disposed feed reels 16 for the silver halide photosensitive material (S).

In the processing housing 4, a wall material 14 is placed. It forms the passageway 15 having a width of 3 mm together with the top-forming material 12. Thus the material 12 and the wall material 14 together form the wavy passageway 15. At the upper and lower bends of the passageway, feed reels 16 for the photosensitive material are provided. In FIG. 1, one reel 16 is provided at the top and two reels 16 are provided at the bottom.

The processing passageway 15 has supply ports 3 and 13 and overflow ports 5 and 11. The processing solution fed through the supply ports is discharged through the overflow ports. A part (D) extending from the suply port 3 to the overflow port 5 is filled with the color development/fixing solution and a part (W) extending from the supply port 13 to the overflow port 11 is filled with washing water. The color development/fixing solution required for the processing is supplied through the supply port 3 and the washing water is supplied through the supply port 13. These supply ports 3 and 13 are located slightly higher than the overflow ports 5 and 11. A feed reel 17 and a take-off reel 18 for the photosensitive material are placed on the left and right, respectively, above the passageway 15. The take-off reel 18 is connected with a drying part 19. Another take-off reel 21 is placed on the right above the drying part 19. The developing housing 4 is filled with warm water to keep the temperature of the developing solution constant. The photosensitive material S is sent to the passageway 15 through the reel 17 and is developed while it is conveyed by the reels 16, then it is conveyed by the take-off reel 18 into the drying part and the dried product is taken off.

The dye covering power (DCP) of the coupler used in the present invention was determined by the following experiment:

Preparation of Coated Sample 10 mmol of a coupler to be tested was dissolved in a mixture of 20 ml of trioctyl phosphate and 20 ml of ethyl acetate. The solution was emulsion-dispersed in 200 ml of 10% gelatin solution containing 10 ml of 10% sodium dodecylbenzenesulfonate. 123 g of a silver chlorobromide emulsion (silver bromide: 60 molar %, average grain diameter: 0.4 μm, silver content: 70 g/kg, gelatin content: 70 g/kg) and 1400 g of 10% gelatin were added to the emulsified dispersion. Sodium 1-oxy-3,5-dichloro-s-triazine as the hardener was added thereto and the coating solution thus prepared was applied to a cellulose triacetate film in such an amount that the amount of the coupler would be 1 mmol/m$^2$ (silver: 8 mmol/m$^2$). Then a gelatin protective layer having a thickness of 1 μm was formed thereon to prepare a coated sample. The coupler used is shown in Table 1.

Determination of Dye Covering Power

The coated samples were exposed by stepwise method and then subjected to the development by the following steps:

| | |
|---|---|
| 1. Color development | 33° C., 3 min 30 sec. |
| 2. Fixing | 33° C., 5 min |
| 3. Washing with water | 33° C., 10 min. |

The composition of the processing solutions were as shown below:

| | | |
|---|---|---|
| Color developer | | |
| Triethanolamine | | 8.0 g |
| Sodium bromide | | 1.7 g |
| N-Ethyl-N-(β-methanesulfonamidoethyl)-3-methyl-4-aminoaniline sulfate | | 5.0 g |
| N,N-Bis(carboxyethyl)hydrazine | | 5.0 g |
| Potassium carbonate | | 30.0 g |
| Water | ad | 1 l |
| pH adjusted to 10.05 | | |
| Fixing solution | | |
| Sodium thiosulfate | | 50.0 g |
| Water | ad | 1 l |

After drying, the amount of developed silver in each step was determined with a fluorescent X-ray silver meter (S mmol/m$^2$). The sample was desilverized in the following steps:

| | | |
|---|---|---|
| 1. Bleach-fixing | 33° C., 5 min | |
| 2. Washing with water | 33° C., 10 min | |
| Bleach-fixing solution | | |
| Ammonium thiosulfate (700 g/l) | | 200.0 g |
| Sodium sulfite | | 40.0 g |
| Ferric ethylenediaminetetraacetate | | 100.0 g |
| Disodium ethylenediaminetetraacetate | | 5.0 g |
| Ammonium bromide | | 40.0 g |
| Water | ad | 1 l |

After drying, the transmission density in each step was determined with a densitometer (FSD-103, product of Fuji Photo Film Co., Ltd.). Blue light density (yellow color image), green light density (magenta color image) and red light density (cyan color image) were determined under the above-described conditions. The density D was plotted against the amount of developed silver (S) and the dye covering power (DCP) (density/silver mmol/m$^2$) was determined from the slope of the straight line part of the graph. The results are shown in Table 1.

TABLE 1

| Coupler | DCP |
|---|---|
| Y-I-3 | 0.84 |
| Y-I-6 | 0.81 |
| Y-II-2 | 1.06 |
| M-I-1 | 1.25 |
| M-III-1 | 1.54 |
| C-II-1 | 1.09 |
| C-II-2 | 1.09 |
| C-IV-5 | 1.03 |
| Comparative coupler (a)* | 0.63 |
| Comparative coupler (b)* | 0.32 |

TABLE 1-continued

| | |
|---|---|
| Comparative coupler (c)* | 0.52 |

*Comparative coupler (a)

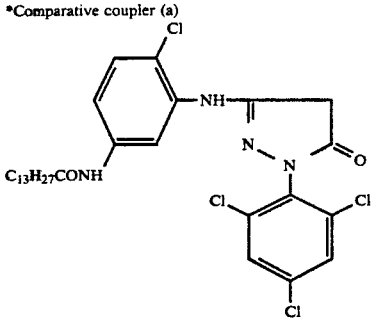

Comparative coupler (b)

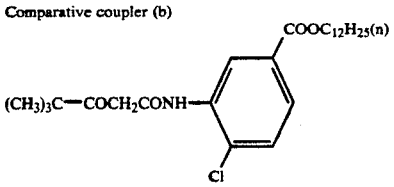

Comparative coupler (c)

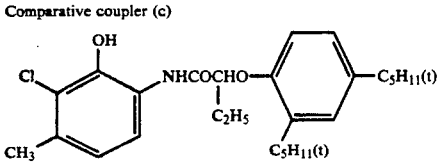

The couplers used in the present invention had a DCP value of as high as above 0.75. On the contrary, although the Comparative Coupler (a)* had a high activity, it was a so-called 4-equivalent coupler having a DCP value of as low as below 0.75 and it formed a large amount of developed silver. It was unsuitable for the monobath development/fixing process of the present invention. Since comparative couplers (b) and (c) had a low DCP value, they were also unsuitable.

EXAMPLE 1

10 mmol of Magenta coupler (M-III-1) was dissolved in a mixture of 20 ml of trioctyl phosphate and 20 ml of ethyl acetate. The solution was emulsion-dispersed in 200 ml of 10% gelatin solution containing 10 ml of 10% sodium dodecylbenzenesulfonate. 123 g of silver chlorobromide emulsion (silver chloride content: 99 molar %, average grain diameter: 0.4 μm, silver content: 70 g/kg, gelatin content: 70 g/kg) and 1400 g of 10% gelatin were added thereto. Sodium 1-hydroxy-3,5-dichloro-s-triazine as the hardener was added thereto and the coating solution thus prepared was applied to a cellulose triacetate film in such an amount that the amount of the coupler would be 0.5 mmol/m$^2$ (silver: 2 mmol/m$^2$). Then a gelatin protective layer having a thickness of 1 μm was formed thereon to prepare Sample 201.

The sample was exposed by the stepwise method and then processed with the following processing solutions by the following steps by means of the automatic developing machine shown in FIG. 1:

| Step | Time | Temperature | Tank capacity |
|---|---|---|---|
| Color development/fixing | 45 sec | 38° C. | 720 ml |
| Washing with water | 45 sec | 38° C. | 720 ml |
| Drying | 35 sec | 75° C. | |

Color development/fixing solution

-continued

| | |
|---|---|
| Deionized water | 800 ml |
| Ethylenediamine-N,N,N',N'-tetramethylene-phosphonic acid | 3 g |
| Potassium carbonate | 25 g |
| Potassium chloride | 1 g |
| Triethanolamine | 5 g |
| Diethylhydroxylamine | 5 g |
| N-Ethyl-N-(β-methanesulfonamidoethyl)-3-methyl-4-aminoaniline sulfate | 7 g |
| Fluorescent brightener (WHITEX 4 mfd. by Sumitomo Chemical Co., Ltd.) | 1 g |
| Solvent for silver halide | see Table 2 |
| pH adjusted with potassium hydroxide | 10.10 |
| Deionized water | ad 1,000 ml |
| Washing water | |
| Deionized water (calcium content and magnesium content: less than 3 ppm) | |

After drying, the maximum density ($D_{max}$), minimum density ($D_{min}$), as well as blue density ($D_B$) and red density ($D_R$) at a green density ($D_G$) of 1.0 were determined to obtain the results shown in Table 2.

TABLE 2

| Process | Solvent for silver halide | Amount [mol/l] | Photographic properties $D_{min}$ | $D_{max}$ | Dc = 1.0 $D_B$ | $D_R$ |
|---|---|---|---|---|---|---|
| 1 | | — | 0.18 | 2.35 | 0.25 | 0.18 |
| 2 | | $1.25 \times 10^{-2}$ | 0.09 | 2.30 | 0.15 | 0.10 |
| 3 | Compound-1(1) | $2.5 \times 10^{-2}$ | 0.05 | 2.24 | 0.08 | 0.06 |
| 4 | | $5.0 \times 10^{-2}$ | 0.03 | 2.20 | 0.07 | 0.04 |
| 5 | | $1.25 \times 10^{-2}$ | 0.10 | 2.30 | 0.17 | 0.12 |
| 6 | Compound-2(2) | $2.5 \times 10^{-2}$ | 0.06 | 2.25 | 0.09 | 0.07 |
| 7 | | $5.0 \times 10^{-2}$ | 0.04 | 2.19 | 0.08 | 0.05 |

(1)Compound-1 Sodium thiosulfate
(2)Compound-2 $HOCH_2CH_2SCH_2CH_2SCH_2CH_2OH$

It is apparent from Table 2 that in the Processes 2 to 4 and 5 to 7 wherein the solvent for the silver halide was used, the minimum density was low and the clarity of the color was higher, while in the Process (1) wherein no solvent for the silver halide was used, the minimum density ($D_{min}$) was high and the clarity of color was poor.

EXAMPLE 2

Samples 302 and 303 were prepared in the same manner as that of preparation of Sample 201 in Example 1 except that silver chlorobromide having a silver chloride content of 90 molar % or silver chlorobromide having silver chloride content of 95 molar % was used. These samples and Sample 201 were exposed by the staircase method in the same manner as that of Example 1 and processed in the same manner as that of Example 1. For comparison, Comparative Samples 301 and 304 were prepared in the same manner as that of the preparation of Sample 201 except that silver chlorobromide having a silver chloride content of 80 molar % or pure silver chloride was used. The results are shown in Table 3.

TABLE 3

| Sample No. | AgCl content of silver halide emulsion | Solvent for silver halide [mol/l] | Photographic properties $D_{min}$ | $D_{max}$ | Dc = 1.0 $D_B$ | $D_R$ |
|---|---|---|---|---|---|---|
| 301 | 80 molar/% | | 0.06 | 1.87 | 0.15 | 0.09 |
| 302 | 90 molar/% | Compound-1* | 0.06 | 2.13 | 0.10 | 0.07 |
| 303 | 95 molar/% | | 0.05 | 2.22 | 0.08 | 0.06 |
| 201 | 99 molar/% | $2.5 \times 10^{-2}$ | 0.05 | 2.24 | 0.08 | 0.06 |
| 304 | 100 molar/% | | 0.15 | 1.68 | 0.08 | 0.07 |

TABLE 3-continued

| Sample No. | AgCl content of silver halide emulsion | Solvent for silver halide [mol/l] | Photographic properties $D_{min}$ | $D_{max}$ | Dc = 1.0 $D_B$ | $D_R$ |
|---|---|---|---|---|---|---|
| 301 | 80 molar/% | | 0.08 | 1.85 | 0.16 | 0.10 |
| 302 | 90 molar/% | Compound-2* | 0.07 | 2.13 | 0.11 | 0.08 |
| 303 | 95 molar/% | | 0.06 | 2.23 | 0.09 | 0.07 |
| 201 | 99 molar/% | $2.5 \times 10^{-2}$ | 0.06 | 2.25 | 0.09 | 0.07 |
| 304 | 100 molar/% | | 0.16 | 1.72 | 0.09 | 0.08 |

*See the footnote to Table 2.

It is apparent from Table 3 that the maximum density becomes low and poor color clarity increases in the case where the silver halide emulsion layer is reduced. Comparative sample 301 had a low maximum density and poor color clarity while Comparative Sample 304 containing pure silver chloride had a low maximum density and a high minimum density. On the other hand, Samples 302, 303 and 201 had excellent results, in particuler, Sample 201 was most excellent.

EXAMPLE 3

Samples 401 and 402 were prepared in the same manner as that of the preparation of Sample 201 except that Magenta coupler M-III-1 was replaced with M-I-1 and M-II-3, respectively. Comparative Sample 403 was also prepared in the same manner as that of the preparation of the Sample 201 except that magenta coupler M-III-1 was replaced with Comparative Coupler (a). The samples were processed and subjected to the determination in the same manner as that of Example 1. The results are shown in Table 4.

TABLE 4

| Sample No. | Coupler | Solvent for silver halide [mol/l] | Photographic properties $D_{min}$ | $D_{max}$ | $D_G$ = 1.0 $D_B$ | $D_R$ |
|---|---|---|---|---|---|---|
| 201 | M-III-1 | Compound-1* | 0.05 | 2.24 | 0.08 | 0.06 |
| 401 | M-I-1 | | 0.06 | 2.37 | 0.12 | 0.08 |
| 402 | M-II-3 | | 0.05 | 2.16 | 0.08 | 0.06 |
| 403 | Comparative coupler(a)(1) | $2.5 \times 10^{-2}$ | 0.14 | 1.68 | 0.20 | 0.16 |
| 201 | M-III-1 | Compound-2* | 0.06 | 2.25 | 0.09 | 0.07 |
| 401 | M-I-1 | | 0.07 | 2.37 | 0.13 | 0.09 |
| 402 | M-II-3 | | 0.06 | 2.17 | 0.09 | 0.07 |
| 403 | Comparative coupler(a)(1) | $2.5 \times 10^{-2}$ | 0.15 | 1.66 | 0.21 | 0.18 |

(1)Comparative coupler(a)

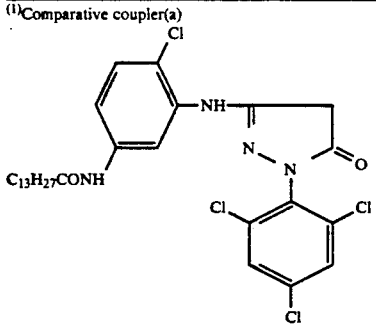

*See footnote to Table 2 in Example 1.

It is apparent from the above-described results that the Comparative Sample 403 containing the Comparative Coupler (a) had a low maximum density and poor color clarity, while Samples 401 and 402 exhibited excellent results similar to those of Sample 201.

EXAMPLE 4

Sample 501 was prepared in the same manner as that of the preparation of Sample 201 except that Coupler M-III-1 in Example 1 was replaced with Yellow Coupler Y-II-1 and the amounts of the coupler and silver applied were changed to 1 mmol/m$^2$ and 4 mmol/m$^2$, respectively. Further Samples 502 and 503 were prepared in the same manner as that of the Preparation of Sample 501 except that Yellow Coupler Y-I-6 and Y-I-1, respectively, were used. The results obtained after the processing and determination conducted in the same manner as that of Example 3 are shown in Table 5. Comparative Sample 504 was prepared in the same manner as above except that Yellow Coupler Y-II-1 of Sample 501 was replaced with Comparative Coupler (b). The processing and determination were conducted in the same manner as above. The Sample 504 containing the comparative coupler had a low maximum density and poor color clarity, while the results of Samples 501, 502 and 503 were excellent.

TABLE 5

| Sample No. | Yellow coupler | Solvent for silver halide [mol/l] | Photographic properties $D_{min}$ | $D_{max}$ | $D_G$ = 1.0 $D_B$ | $D_R$ |
|---|---|---|---|---|---|---|
| 501 | Y-II-1 | Compound-1* | 0.05 | 2.37 | 0.15 | 0.08 |
| 502 | Y-I-6 | | 0.06 | 1.90 | 0.13 | 0.09 |
| 503 | Y-I-1 | | 0.05 | 1.96 | 0.14 | 0.08 |
| 504 | Comparative coupler(b)(1) | $2.5 \times 10^{-2}$ | 0.11 | 1.13 | 0.20 | 0.15 |
| 501 | Y-II-1 | Compound-2* | 0.05 | 2.36 | 0.15 | 0.08 |
| 502 | Y-I-6 | | 0.06 | 1.90 | 0.13 | 0.09 |
| 503 | Y-I-1 | | 0.05 | 1.95 | 0.14 | 0.08 |
| 504 | Comparative coupler(b)(1) | $2.5 \times 10^{-2}$ | 0.11 | 1.11 | 0.21 | 0.16 |

(1)Comparative coupler(b)

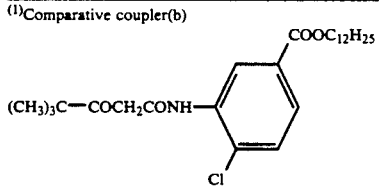

*See footnote to Table 2 in Example 1.

EXAMPLE 5

Sample 601 was prepared in the same manner as that of the preparation of the Sample 201 except that Coupler M-III-1 used in Example 1 was replaced with Cyan Coupler C-II-1 and the amounts of the coupler and silver were changed into 1 mmol/m$^2$ and 4 mmol/m$^2$, respectively. Further Samples 602 and 603 were prepared in the same manner as that of the preparation of Sample 601 except that Cyan coupler C-I-4 or C-II-2 was used. The processing and determination were conducted in the same manner as above. It is apparent that Sample 604 containing the comparative coupler had a low maximum density and poor color clarity, while the results of Samples 601, 602 and 603 were excellent.

TABLE 6

| Sample No. | Cyan coupler | Solvent for silver halide [mol/l] | Photographic properties $D_{min}$ | $D_{max}$ | $D_G$ = 1.0 $D_B$ | $D_R$ |
|---|---|---|---|---|---|---|
| 601 | C-II-1 | Compound-1* | 0.04 | 2.34 | 0.18 | 0.20 |
| 602 | C-I-4 | | 0.04 | 2.31 | 0.18 | 0.20 |
| 603 | C-II-2 | | 0.04 | 2.47 | 0.19 | 0.21 |
| 604 | Comparative coupler(c)(1) | $2.5 \times 10^{-2}$ | 0.07 | 1.98 | 0.30 | 0.32 |
| 601 | C-II-1 | Compound-2* | 0.04 | 2.35 | 0.18 | 0.20 |
| 602 | C-I-4 | | 0.04 | 2.31 | 0.18 | 0.20 |
| 603 | C-II-2 | | 0.04 | 2.47 | 0.19 | 0.21 |
| 604 | Comparative | $2.5 \times 10^{-2}$ | 0.07 | 1.96 | 0.31 | 0.33 |

TABLE 6-continued

| Sample No. | Cyan coupler | Solvent for silver halide [mol/l] | Photographic properties $D_{min}$ | $D_{max}$ | $D_G = 1.0$ $D_B$ | $D_R$ |
|---|---|---|---|---|---|---|
| | coupler(c)[1] | | | | | |

[1]Comparative coupler(c)

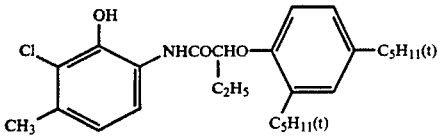

*Compounds: See footnote to Table 2 in Example 1.

EXAMPLE 6

Multi-layer color photographic papers comprising a paper support having the both surfaces laminated with polyethylene were prepared. The coating solutions were prepared as follows:

Preparation of the First Layer-Forming Coating Solution 27.2 ml of ethyl acetate and 8.2 g of a solvent (Solv-3) were added to a mixture of 19.1 g of yellow coupler (ExY), 4.4 g of color image stabilizer (Cpd-1) and 0.7 g of color image stabilizer (Cpd-7) to form a solution. The solution was emulsion-dispersed in 18.5 ml of 10% aqueous gelatin solution containing 8 ml of 10% sodium dodecylbenzenesulfonate. On the other hand, $2.0\times10^{-4}$ mol (for large-size emulsion) or $2.5\times10^{-4}$ mol (for small-sized emulsion), per mol of silver, of a blue-sensitive sensitizing dye which will be shown below was added to a silver chlorobromide emulsion [comprising a mixture of those having an average cubic grain size of 0.88 μm and those 0.70 μm in a molar ratio (in terms of silver) of 3:7, coefficient of variation of the grain size distribution: 0.08 or 0.10, 0.2 molar % of silver bromide being contained in the grain shell in each emulsion] and the mixture was sensitized with sulfur. The emulsified dispersion prepared as described above was mixed with this emulsion to obtain a solution, from which will be shown below was prepared. Coating solutions for forming the second layer to the seventh layer were also prepared in the same manner as described above. Sodium 1-hydroxy-3,5-dichloro-s-triazine was used as the hardener in each layer.

The spectral sensitizing dye in each layer was as follows:

Blue-sensitive emulsion layer:

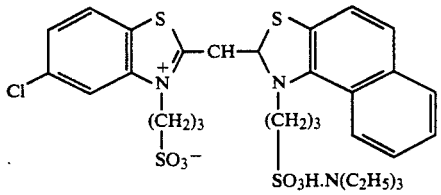

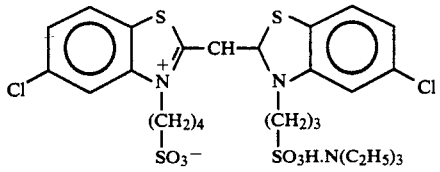

[$2.0\times10^{-4}$ mol (for large size emulsion) or $2.5\times10^{-4}$ mol (for small size emulsion) per mol of the silver halide].

Green-sensitive emulsion layer:

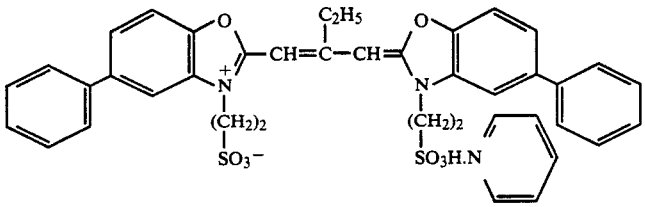

[$4.0\times10^{-4}$ mol (for large size emulsion and $5.6\times10^{-4}$ mol (for small size emulsion) per mol of the silver halide]. and

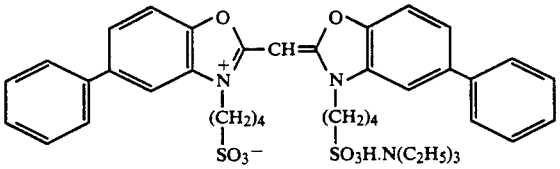

[$7.0\times10^{-5}$ (for large size emulsion) or $1.0\times10^{-5}$ mol (for small size emulsion) per mol of the silver halide].

Red-sensitive emulsion layer:

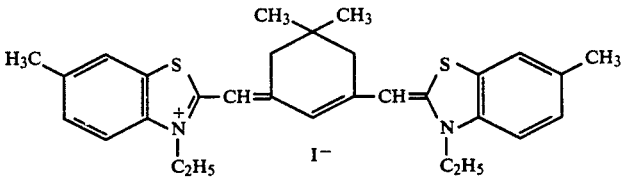

[$0.9\times10^{-4}$ mol (for large size emulsion) or $1.1\times10^{-4}$ mol (for small size emulsion) per mol of the silver halide].

$2.6\times10^{-3}$ mol, per mol of the silver halide, of the following compound was incorporated into the red-sensitive emulsion layer:

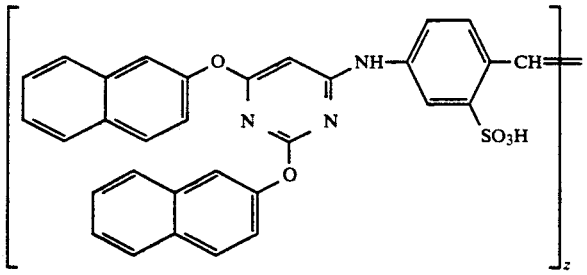

$8.5\times10^{-5}$ mol, $7.7\times10^{-4}$ mol and $2.5\times10^{-4}$ mol, per mol of the silver halide, of 1-(5-methylureido-phenyl)-5-mercaptotetrazole was added to the blue-sensitive emulsion layer, green-sensitive emulsion layer and red-sensitive emulsion layer, respectively.

For preventing the irradiation, the following dyes were incorporated into the emulsion layers:

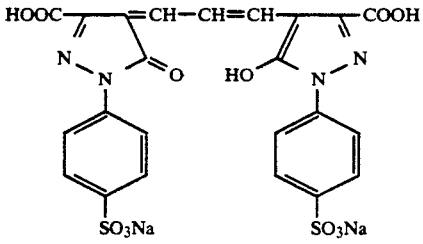

and

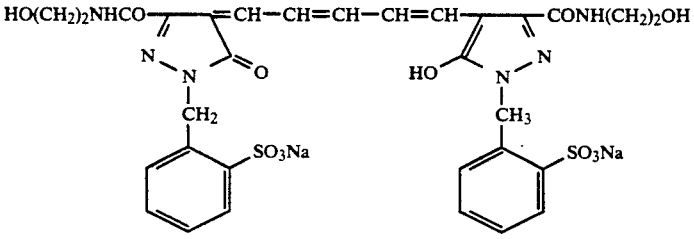

Layer Structure

The compositions of the respective layers will be shown below. The numerals represent the amounts of the coatings ($g/m^2$). The amount of silver halide emulsion was given in terms of silver in the coating layer.

| | |
|---|---|
| Support | |
| Polyethylene-laminated paper | |
| [the polyethylene layer on the first layer-side contains a white pigment ($TiO_2$) and a blue dye (ultramarine)] | |
| The first layer (blue-sensitive layer) | |
| The silver chlorobromide emulsion (silver chloride content: 99.8 molar %) | 0.30 |
| Gelatin | 1.86 |
| Yellow coupler (Y-1-3, Y-1-6) (DCP = 0.84 and 0.81, respectively) | 0.85 |
| Color image stabilizer (Cpd-1) | 0.19 |
| Solvent (Solv-3) | 0.35 |
| Color image stabilizer (Cpd-7) | 0.06 |
| The second layer (color mixing-inhibiting layer) | |
| Gelatin | 0.99 |
| Color mixing inhibitor (Cpd-5) | 0.08 |
| Solvent (Solv-1) | 0.16 |
| Solvent (Solv-4) | 0.08 |
| The third layer (green-sensitive layer) | |
| Silver chlorobromide emulsion | 0.12 |
| [mixture of cubic grains having average grain sizes of 0.55 μm and 0.39 μm in a molar ratio (in terms of Ag) of 1:3; coefficient of variation of grain size distribution: 0.10 and 0.08; 0.8 molar % of AgBr being contained in the grain shells in each emulsion; silver chloride content: 99.2 molar %) | |
| Gelatin | 1.24 |
| Magenta Coupler (M-III-13) (DCP = 1.48) | 0.22 |
| Color image stabilizer (Cpd-3) | 0.15 |
| Color image stabilizer (Cpd-4) | 0.02 |
| Color image stabilizer (Cpd-9) | 0.03 |

-continued

| | |
|---|---|
| Solvent (Solv-2) | 0.40 |
| The fourth layer (U.V. ray-absorbing layer) | |
| Gelatin | 1.58 |
| U.V. absorber (UV-1) | 0.47 |
| Color mixing inhibitor (Cpd-5) | 0.05 |
| Solvent (Solv-5) | 0.24 |
| The fifth layer (red-sensitive layer) | |
| Silver chlorobromide emulsion [mixture of cubic grains having average grain sizes of 0.58 μm and 0.45 μm in a molar ratio (in terms of Ag) of 1:4; coefficient of variation of grain size distribution: 0.09 and 0.11; 0.6 molar % of AgBr being contained in the grain shells in each emulsion; silver chloride content: 99.4 molar %) | 0.23 |
| Gelatin | 1.34 |
| Cyan coupler (C-II-3, C-II-10 and C-I-2) (DCP = 1.02, 1.28 and 0.86) | 0.36 |
| Color image stabilizer (Cpd-6) | 0.17 |
| Color image stabilizer (Cpd-8) | 0.04 |
| Color image stabilizer (Cpd-7) | 0.40 |
| Solvent (Solv-6) | 0.15 |
| The sixth layer (U.V.-absorbing layer) | |
| Gelatin | 0.53 |
| U.V. absorber (UV-1) | 0.16 |
| Color mixing inhibitor (Cpd-5) | 0.02 |
| Solvent (Solv-5) | 0.08 |
| The seventh layer (protective layer) | |
| Gelatin | 1.33 |
| Acryl-modified polyvinyl alcohol copolymer (degree of modification: 17%) | 0.17 |
| Liquid paraffin | 0.03 |

(ExY) Yellow coupler

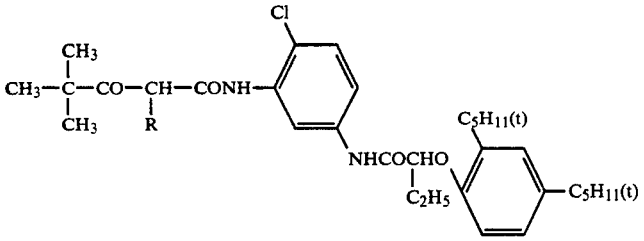

A mixture of (Y-I-13) wherein R is:

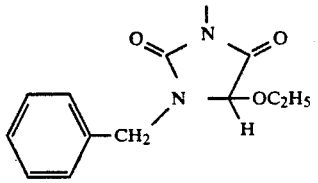

and (Y-I-6) wherein R is:

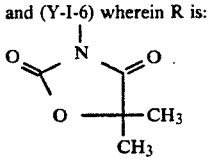

in a molar ratio of 1:1

(ExM) magenta coupler
(M-III-13)

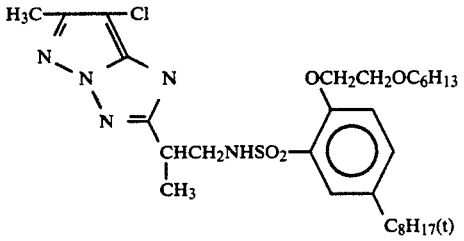

(ExC) Cyan coupler A mixture of

-continued
(C-II-13)
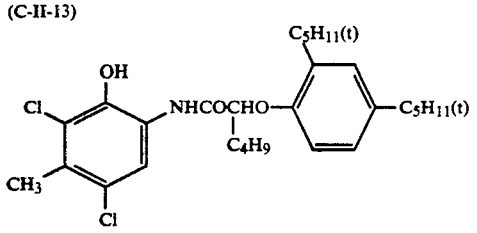
(C-II-10)
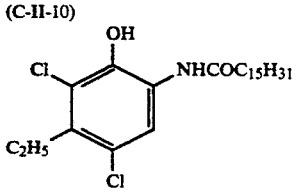
(C-I-2)
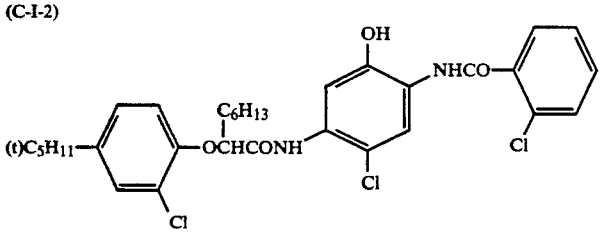
in a weight ratio of 2:4:4
(Cpd-1) Color image stabilizer
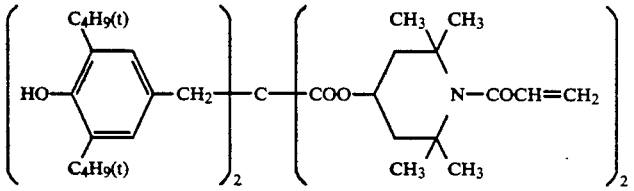
(Cpd-3) Color image stabilizer
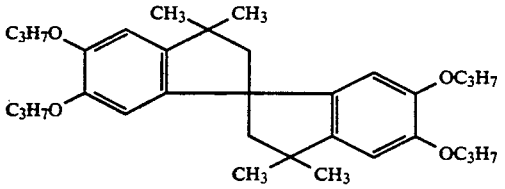
(Cpd-5) Color mixing inhibitor
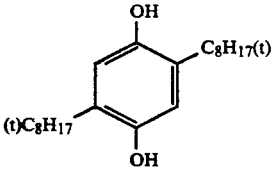
(Cpd-6) Color mixing inhibitor A mixture of:
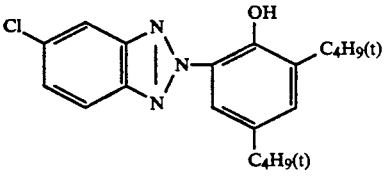

-continued
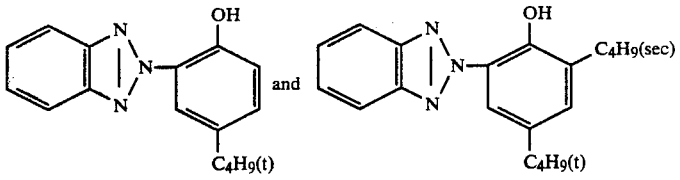
in a weight ratio of 2:4:4
(Cpd-4) Color image stabilizer
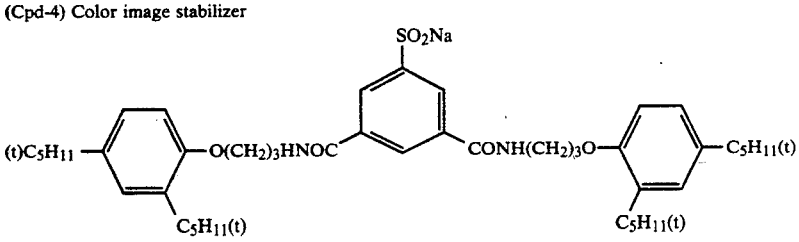
(Cpd-9) Color image stabilizer
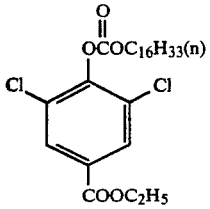
(Cpd-7) Color image stabilizer
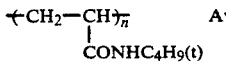
Average molecular weight: 60,000
(Cpd-8) Color image stabilizer
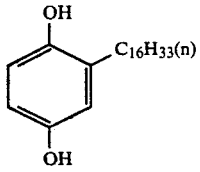
(UV-1) U.V. absorber
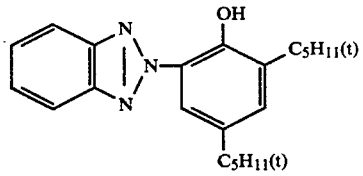
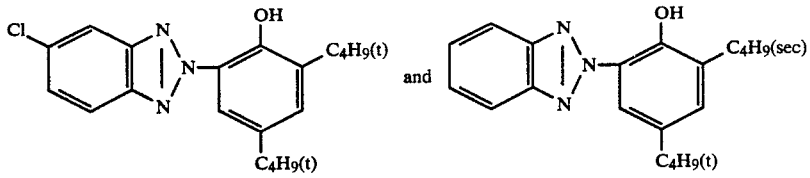
in a weight ratio of 4:2:4
(Solv-1) Solvent
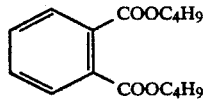
(Solv-2) Solvent A mixture of:

-continued

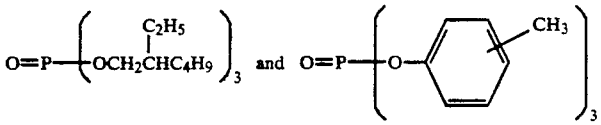

in a volume ratio of 2:1

(Solv-3) Solvent $O{=}P{-}(O{-}C_9H_{19}(iso))_3$ (Solv-4) Solvent

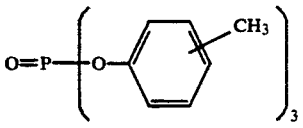

(Solv-5) Solvent $(COOC_8H_{17})_2(CH_2)_8$ (Solve-6) Solvent A mixture of:

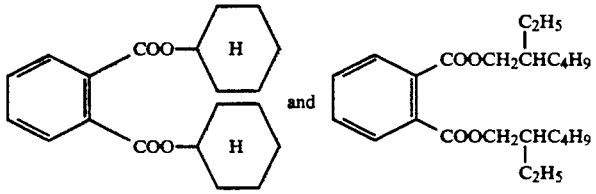

in a weight ratio of 1:1

The sample thus prepared will be referred to as Sample 701. The Sample 701 was exposed to a light of 250 CMS through a wedge fronted with a B-G-R separation filter.

The exposure time was 0.1 sec.

The Sample 701 thus exposed was processed with the same processing solutions and by the same processing steps as those of Example 1 except that the concentration of the solvent for the silver halide used for preparing the color development/fixing solution was changed as shown in Table 7. The results are also shown in Table 7.

For comparison, the Sample 701 exposed under the same conditions as above was processed with running processing solution with a paper-processing machine by a processing method usually employed in the art at present. The properties of the thus processed Sample 701 are also shown in Table 7 (Process No. 19).

| Processing step | Temperature | Time | Quantity of* replenisher | Capacity of tank |
|---|---|---|---|---|
| Color development | 35° C. | 45 sec | 161 ml | 17 l |
| Bleach-fixing | 30 to 36° C. | 45 sec | 215 ml | 17 l |
| Stabilization (1) | 30 to 37° C. | 20 sec | — | 10 l |
| Stabilization (2) | 30 to 37° C. | 20 sec | — | 10 l |
| Stabilization (3) | 30 to 37° C. | 20 sec | — | 10 l |
| Stabilization (4) | 30 to 37° C. | 30 sec | 284 ml | 10 l |
| Drying | 70 to 85° C. | 60 sec | | |

*per $m^2$ of photosensitive material

[In the stabilization, four tanks were arranged countercurrently from stabilization (4) to (1)]

The compositions of the processing solutions were as shown below:

| Color developer | Tank | Replenisher |
|---|---|---|
| Water | 800 ml | 800 ml |
| Ethylenediaminetetraacetic acid | 2.0 g | 2.0 g |
| 5,6-Dihydroxybezene-1,2,4-trisulfonic acid | 0.3 g | 0.3 g |
| Triethanolamine | 8.0 g | 8.0 g |
| Sodium chloride | 1.4 g | — |
| Potassium carbonate | 25 g | 25 g |
| N-ethyl-N-(β-methanesulfonamido-ethyl)-3-methyl-4-aminoaniline sulfate | 5.0 g | 7.0 g |
| Diethylhydroxylamine | 4.2 g | 6.0 g |
| Fluorescent brightener (WHITEX 4 mfd. by Sumitomo Chemical Co., Ltd.) | 2.0 g | 2.5 g |
| Water | ad 1000 ml | ad 1000 ml |
| pH (25° C.) | 10.05 | 10.45 |

Bleach-fixing solution (The solution in the tank was the same as the replenisher)

| | |
|---|---|
| Water | 400 ml |
| Ammonium thiosulfate (700 g/l) | 100 ml |
| Sodium sulfite | 17 g |
| Ferric ammonium ethylenediaminetetraacetate | 55 g |
| Disodium ethylenediaminetetraacetate | 5 g |
| Glacial acetic acid | 9 g |
| Water | ad 1000 ml |
| pH (25° C.) | 5.40 |

Stabilizing solution (The solution in the tank was the same as the replenisher)

| | |
|---|---|
| Formalin (37%) | 0.1 g |
| Formalin/sulfurous acid adduct | 0.7 g |
| 5-Chloro-2-methyl-4-isothiazoline-3-on | 0.02 g |
| 2-Methyl-4-isothiazoline-3-on | 0.01 g |
| Copper sulfate | 0.005 g |
| Water | ad 1000 ml |

-continued

| | |
|---|---|
| pH (25° C.) | 4.0 |

TABLE 7

| Process No. | Solvent for silver halide (sodium thiosulfate) [mol/l] | BL Photographic properties $D_{min}$ | BL Photographic properties $D_{max}$ | BL $D_G = 1.0$ $D_G$ | BL $D_G = 1.0$ $D_R$ | GL Photographic properties $D_{min}$ | GL Photographic properties $D_{max}$ | GL $D_G = 1.0$ $D_B$ | GL $D_G = 1.0$ $D_R$ | RL Photographic properties $D_{min}$ | RL Photographic properties $D_{max}$ | RL $D_G = 1.0$ $D_B$ | RL $D_G = 1.0$ $D_G$ |
|---|---|---|---|---|---|---|---|---|---|---|---|---|---|
| 11 | — | 0.39 | 2.25 | 0.36 | 0.23 | 0.36 | 2.42 | 0.50 | 0.31 | 0.37 | 2.53 | 0.62 | 0.63 |
| 12 | $0.05 \times 10^{-2}$ | 0.37 | 2.24 | 0.35 | 0.22 | 0.34 | 2.40 | 0.47 | 0.29 | 0.35 | 2.51 | 0.59 | 0.60 |
| 13 | $0.1 \times 10^{-2}$ | 0.29 | 2.20 | 0.31 | 0.19 | 0.25 | 2.38 | 0.38 | 0.25 | 0.27 | 2.47 | 0.49 | 0.51 |
| 14 | $1.0 \times 10^{-2}$ | 0.21 | 2.13 | 0.28 | 0.17 | 0.17 | 2.32 | 0.30 | 0.22 | 0.19 | 2.39 | 0.40 | 0.42 |
| 15 | $5.0 \times 10^{-2}$ | 0.17 | 2.03 | 0.26 | 0.16 | 0.14 | 2.23 | 0.26 | 0.20 | 0.16 | 2.30 | 0.35 | 0.37 |
| 16 | $50 \times 10^{-2}$ | 0.16 | 1.92 | 0.25 | 0.16 | 0.13 | 2.14 | 0.25 | 0.19 | 0.15 | 2.23 | 0.33 | 0.36 |
| 17 | $100 \times 10^{-2}$ | 0.16 | 1.81 | 0.25 | 0.16 | 0.12 | 2.04 | 0.25 | 0.19 | 0.15 | 2.15 | 0.33 | 0.36 |
| 18 | $200 \times 10^{-2}$ | 0.16 | 1.74 | 0.25 | 0.16 | 0.12 | 1.98 | 0.25 | 0.19 | 0.15 | 2.09 | 0.33 | 0.36 |
| 19 | — | 0.12 | 2.30 | 0.22 | 0.15 | 0.09 | 2.45 | 0.21 | 0.17 | 0.12 | 2.55 | 0.28 | 0.33 |

It is apparent from the results shown in Table 7 that among the color photosensitive materials comprising the emulsion having a high silver chloride content and the coupler having a DCP of at least 0.75, Comparative Sample No. 11 free from the solvent for the silver halide or containing only a small amount of the solvent had a high minimum density ($D_{min}$) and poor color clarity and that a sufficient color density could not be obtained when the solvent concentration was high. Therefore, it will be understood that the preferred concentration of the solvent for the silver halide ranges from 0.01 to 0.1 mol/l.

It is also apparent that the properties of the samples were satisfactory and are not inferior to those of the samples processed by a method ordinarily employed in the art.

EXAMPLE 7

Figure 2:
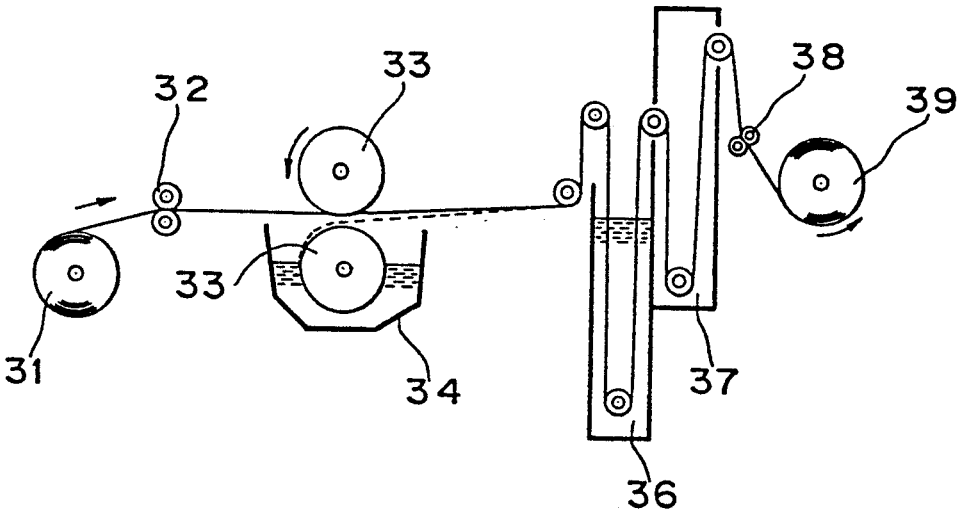
FIG. 2 shows a modified photographic developing machine.

60 ml/m² of the processing solutions kept at a temperature shown below was applied to the Samples 501 to 505 prepared in Example 4 with a developing machine of processing solution-application type (kiss-coat type processing device) shown in FIG. 2.

| Step | Temperature | Time |
|---|---|---|
| Color development/fixing | 40° C. | 30 sec |
| Stabilization | 40° C. | 30 sec |
| Drying | 80° C. | 30 sec |
| Color development/fixing solution | | |
| Deionized water | | 800 ml |
| N-Methyl-N-(β-methanesulfonamidoethyl)-3-methyl-4-aminoaniline hydrochloride | | 9 g |
| Potassium carbonate | | 30 g |
| Triethanolamine | | 5 g |
| N,N-Biscarboxymethylhydrazine (III-9) | | 5 g |
| Sodium thiosulfate | | 3 g |
| pH (adjusted with potassium hydroxide) | | 10.05 |
| Deionized water | | ad 1000 ml |
| Stabilizing solution | | |
| Deionized water | | 800 ml |
| 1-Hydroxyethylidene-1,1-diphosphonic acid | | 5 g |
| Ammonium chloride | | 3 g |
| pH (adjusted with 2.8% aqueous ammonia) | | 7.0 |
| Deionized water | | ad 1000 ml |

Now description will be given on the processing apparatus used with reference to FIG. 2.

The sample from a feed roller 31 is passed through tension rollers 32. The color development/fixing solution is applied to the sample by means of opposed rollers 33. The thickness of the layer of the solution to be applied can be controlled by controlling the space between the rollers. The sample is passed through a tank 36 for washing with water, drying chamber 37 and driving roller 38 and taken off with a take-up roller 39. A solution tank 34 is compactly designed so that the processing can be conducted with a small amount of the solution.

The results obtained by using the above-described processing apparatus are shown in Table 8. It is apparent from Table 8 that the yellow coupler of the present invention exhibited an excellent color developability (high $D_{max}$) and the color clarity was excellent similarly to the results of Example 4 shown in Table 5. The fact that the excellent properties can be obtained with only a small amount of the solution as in this Example is advantageous from the viewpoint of easiness and rapidness of the process and disposal of the waste solution.

TABLE 8

| Sample No. | Yellow coupler | Solvent for silver halide [mol/l] | Photographic properties $D_{min}$ | Photographic properties $D_{max}$ | $D_B = 1.0$ $D_G$ | $D_B = 1.0$ $D_R$ |
|---|---|---|---|---|---|---|
| 501 | Y-II-1 | | 0.05 | 2.35 | 0.15 | 0.08 |
| 502 | Y-I-6 | Compound-1* | 0.06 | 1.88 | 0.13 | 0.09 |
| 503 | Y-I-1 | | 0.05 | 1.96 | 0.14 | 0.08 |
| 504 | Comparative coupler (b)(1) | $2.5 \times 10^{-2}$ | 0.11 | 1.09 | 0.20 | 0.15 |
| 501 | Y-II-1 | | 0.05 | 2.34 | 0.15 | 0.08 |
| 502 | Y-I-6 | Compound-2* | 0.06 | 1.88 | 0.13 | 0.09 |
| 503 | Y-I-1 | | 0.05 | 1.96 | 0.14 | 0.08 |
| 504 | Comparative coupler (b)(1) | $2.5 \times 10^{-2}$ | 0.11 | 1.07 | 0.21 | 0.16 |

(1)Comparative coupler (b) See footnote to TABLE 5
*Solvent for silver halide: Compound-1, -2 See footnote to TABLE 5

The Samples 201, 401 to 403 and 601 to 603 were processed in the same manner as that described above to obtain results similar to those shown in Tables 4 and 6. It is thus apparent that an excellent color image can be obtained by the process of the present invention.

EXAMPLE 8

Sample 901 was parepared in the same manner as that of Example 6 except that Yellow Coupler ExY in the first layer (blue-sensitive layer), Magenta Coupler ExM in the third layer (green-sensitive layer) and Cyan Coupler ExC in the fifth layer (red-sensitive layer) were replaced with an equimolar amount of the following couplers: and further silver halide emulsion in the first layer (blue-sensitive layer) was replaced with an equimolar amount of silver chloroidobromide emulsion (silver iodide 0.2 mol %, silver bromide 0.5 mol %, cubic grains, average grain size 0.65μ, coefficient of variation of grain size distribution 0.12)

Yellow coupler: Y-I-21 (DCP=0.78)

Magenta coupler: M-I-8 (DCP=1.29)

Cyan coupler: mixture of C-I-4 and C-II-2 in a weight ratio of 1:1 (DCP=0.87 and 1.09)

The Sample 901 was exposed under the same conditions as those of Example 6 and processed in the same manner as that of Example 6.

It was found that when no solvent for the silver halide was used or only a small amount thereof was used, the minimum density was high and the color clarity was poor and that when the amount of the solvent was excessive, a sufficient color density could not be obtained, similarly to the results shown in Table 7. It was thus confirmed that the preferred concentration of the solvent for the silver halide ranges from 0.01 to 0.1 mol/l.

EXAMPLE 9

A multi-layer color paper photosensitive material comprising a polyethylene-laminated paper support having layers of the following compositions formed thereon was prepared. The numerals represent the amounts of the applied solution [g/m$^2$]. The amount of the silver halide emulsion was shown in terms of silver.

| | |
|---|---|
| Support | |
| Polyethylene-laminated paper containing white pigment ($TiO_2$) and blue dye (ultramarine) in the polyethylene layer on the first layer side | |
| The first layer (layer containing the main ingredient) | |
| Gelatin | 4.0 |
| Developing agent (Dev-1) | 2.8 |
| Solvent (Solv-1) | 0.75 |
| Hardener (H-1) | 0.04 |
| The second layer (intermediate layer) | |
| Gelatin | 1.0 |
| The third layer (blue-sensitive layer) | |
| Silver chlorobromide emulsion | 0.40 |
| Gelatain | 1.5 |
| Yellow coupler (Y-I-12)(DCP = 0.80) | 0.78 |
| Color image stabilizer (Cpd-1) | 0.17 |
| Color image stabilizer (Cpd-2) | 0.05 |
| Solvent (Solv-2) | 0.26 |
| H-1 | 0.015 |
| The fourth layer (intermediate layer) | |
| Gelatin | 1.0 |
| Color mixing inhibitor (Cpd-3) | 0.10 |
| Solvent (Solv-1) | 0.20 |
| The fifth layer (green-sensitive layer) | |
| Silver chlorobromide emulsion | 0.30 |
| Gelatin | 1.1 |
| Magenta coupler (M-II-5)(DCP = 1.33) | 0.26 |
| Color image stabilizer (Cpd-4) | 0.07 |
| Color image stabilizer (Cpd-5) | 0.01 |
| Color image stabilizer (Cpd-6) | 0.015 |
| Color image stabilizer (Cpd-10) | 0.04 |

-continued

| | |
|---|---|
| Solvent (Solv-3) | 0.52 |
| Hardener (H-1) | 0.011 |
| The sixth layer (intermediate layer) | |
| Gelatin | 1.2 |
| U.V. absorber (UV-1) | 0.50 |
| Color mixing inhibitor (Cpd-3) | 0.10 |
| Solvent (Solv-4) | 0.30 |
| The seventh layer (red-sensitive layer) | |
| Silver chlorobromide emulsion | 0.30 |
| Gelatin | 1.13 |
| Cyan coupler (C-II-2)(DCP = 1.09) | 0.43 |
| Color image stabilizer (Cpd-7) | 0.15 |
| Color image stabilizer (Cpd-8) | 0.04 |
| Color image stabilizer (Cpd-2) | 0.48 |
| Solvent (Solv-5) | 0.22 |
| The eighth layer (U.V.-absorbing layer) | |
| Gelatin | 0.70 |
| U.V. absorber (Cpd-9) | 0.15 |
| Solvent (Solv-4) | 0.10 |
| The ninth layer (protective layer) | |
| Gelatin | 1.0 |
| Acryl-modified polyvinyl alcohol copolymer (degree of modification: 17%) | 0.13 |
| Liquid paraffin | 0.02 |

The silver halide emulsion used in the blue-sensitive layer, green-sensitive layer and red-sensitive layer was the same as that used in Example 6. The spectral sensitizing dye incorporated in these layers was the same and the amount thereof was the same as those in Example 1.

The following compounds were used as the irradiation inhibiting dye:

Disodium [3-carboxy-5-hydroxy-4-(3-(3-carboxy-5-oxo-1-(2,5-disulfonatophenyl)-2-pyrazolin-4-ylidene)-1-propenyl)-1-pyrazolyl]benzene-2,5-disulfonate, Tetrasodium N,N-(4,8-dihydroxy-9,10-dioxo-3,7-disulfonatoanthracene-1,5-diyl)bis(aminomethanesulfonate), and Sodium [3-cyano-5-hydroxy-4-(3-(3-cyano-5-oxo-1-(4-sulfonatophenyl)-2-pyrazolin-4-ylidene)-1-pentanyl)-1-pyrazolyl]benzene-4-sulfonate.

A mixture of the following compounds in the ratio of 7:2:1 was used as the stabilizer for the emulsion layers:

1-(2-acetaminophenyl)-5-mercaptotetrazole,
2-hydroxyethylthio-5-mercaptooxadiazole, and
2-amino-5-mercaptothiadiazole in an amount of $1\times10^{-2}$ mol per mol of the silver halide in each emulsion layer.

The structural formulae of the compounds used are as follows:

Developing agent (Dev-1)

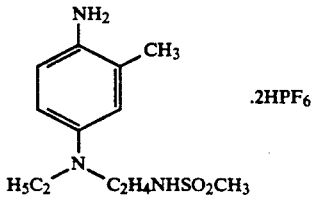

-continued
Color image stabilizer (Cpd-1)
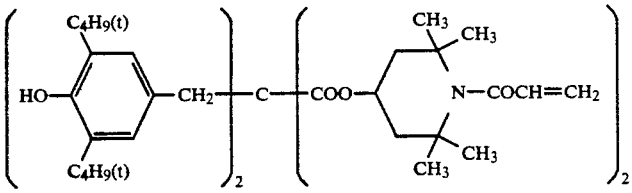
Color image stabilizer (Cpd-2)
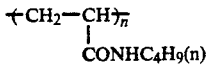
Average molecular weight 60,000
Color mixing inhibitor (Cpd-3)
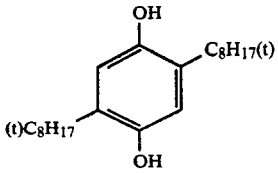
Color image stabilizer (Cpd-4)
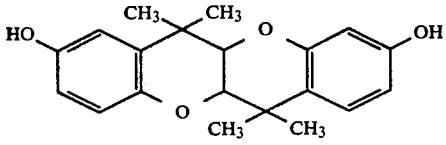
Color image stabilizer (Cpd-5)
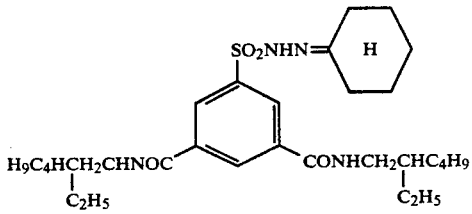
Color image stabilizer (Cpd-6)
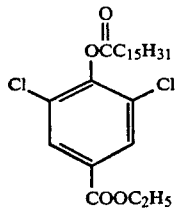
Color image stabilizer (Cpd-7)
A mixture of:
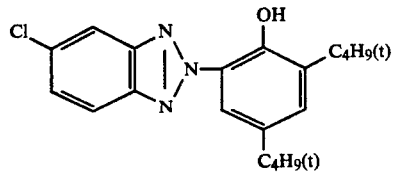
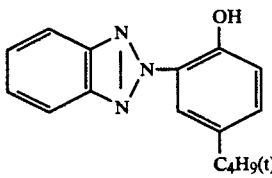
and
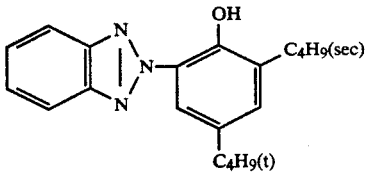
in a weight ratio of 2:4:4

-continued

U.V. absorber (Cpd-9)
A mixture of:

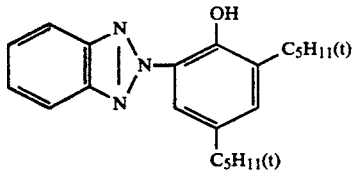

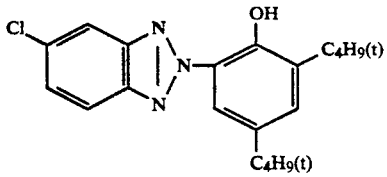

and

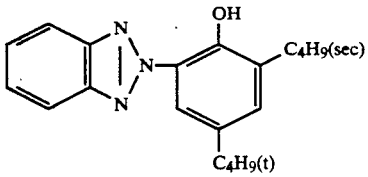

in a weight ratio of 4:2:4

Color image stabilizer (Cpd-10)

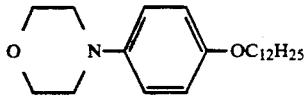

Solvents

Solv-1

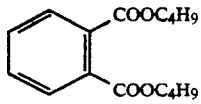

$O{=}P{+}OC_9H_{19}(iso))_3$ Solv-2

Solv-3

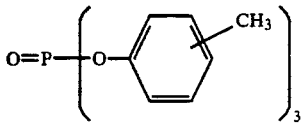

Solv-4

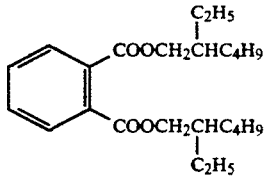

Solv-5

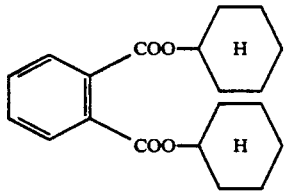

Hardener (H-1)

$CH_2{=}CH{-}SO_2CH_2CH_2SO_2{-}CH{=}CH_2$

The sample thus prepared was exposed to a light of 250 CMS through a wedge fronted with a B-G-R separation filter.

The sample thus exposed was processed as follows:

| Step | Processing temperature | Processing time |
|---|---|---|
| Activator development | 38° C. | 30 sec |
| Washing with water | 38° C. | 30 sec |
| Drying | 70° C. | 30 sec |

Activator development

| | |
|---|---|
| Deionized water | 800 ml |
| 1-Hydroxyethylidene-1,1-diphosphonic acid | 2.0 g |
| Nitrilo-N,N,N-trimethylenephosphonic acid | 1.0 g |
| Sodium chloride | 0.6 g |
| Sodium carbonate monohydrate | 28.0 g |
| Fluorescent brightener (WHITEX 4, mfd. by Sumitomo Chemical Co., Ltd.) | 1.0 g |
| Solvent for silver halide | see TABLE 10 |

-continued

| | |
|---|---|
| Deionized water | ad 1000 ml |
| pH (adjusted with NaOH or $H_2SO_4$) | 10.50 |
| Washing water | |
| Deionized water (having calcium and magnesium content of 3 pm or less) | |

The density of the color image thus obtained by the processing was determined and the photographic properties thereof were examined in the same manner as described above. The results are shown in Table 10.

TABLE 10

| Process No. | Solvent for silver halide* | BL Photographic properties $D_{min}$ | BL Photographic properties $D_{max}$ | BL $D_B = 1.0$ $D_G$ | BL $D_B = 1.0$ $D_R$ | GL Photographic properties $D_{min}$ | GL Photographic properties $D_{max}$ | GL $D_G = 1.0$ $D_B$ | GL $D_G = 1.0$ $D_R$ | RL Photographic properties $D_{min}$ | RL Photographic properties $D_{max}$ | RL $D_R = 1.0$ $D_B$ | RL $D_R = 1.0$ $C_G$ |
|---|---|---|---|---|---|---|---|---|---|---|---|---|---|
| 20 | — | 0.43 | 2.18 | 0.37 | 0.24 | 0.39 | 2.32 | 0.53 | 0.32 | 0.39 | 2.43 | 0.65 | 0.66 |
| 21 | (1)* | 0.25 | 2.10 | 0.29 | 0.18 | 0.19 | 2.25 | 0.32 | 0.23 | 0.20 | 2.30 | 0.42 | 0.43 |
| 22 | (2)** | 0.26 | 2.12 | 0.30 | 0.18 | 0.19 | 2.24 | 0.33 | 0.23 | 0.20 | 2.31 | 0.43 | 0.44 |

*(1) Sodium thiosulfate $2.5 \times 10^{-2}$ mol/l
**(2) $HOCH_2CH_2SCH_2CH_2SCH_2CH_2SCH_2CH_2OH$ $2.5 \times 10^{-2}$ mol/l It is apparent from Table 10 that when the photosensitive material of this Example containing the developing agent was used, a low mininum density and a sufficient color density could be obtained and the color image thus formed had a high color clarity. Thus the processing could be conducted easily and rapidly.

EXAMPLE 10

Sample 701 prepared in Example 6 was exposed under the same conditions as those of Example 6 and the Sample subjected to the image-forming exposure with an automatic developing machine in the following steps was subjected to the running process until the mother liquor of the color development/fixing solution used became twice as much as the tank capacity.

| Processing step | Temperature | Time | Quantity of replenisher | Capacity of tank |
|---|---|---|---|---|
| Color development/-fixing | 38° C. | 45 sec | 161 ml | 17 l |
| Rinsing (1) | 38° C. | 20 sec | — | 10 l |
| Rinsing (2) | 38° C. | 20 sec | 350 ml | 10 l |
| Drying | 70 to 80° C. | 60 sec | — | — |

The quantity of replenisher is given per $m^2$ of the photosensitive material. The rinsing was of counter-current system from (2) to (1) by cascase pipe method.

The compositions of the processing solutions were as follows:

| Color development fixing solution | Tank | Replenisher |
|---|---|---|
| Water | 800 ml | 800 ml |
| Ethylenediamine-N,N,N,N-tetramethylenephosphonic acid | 1.5 g | 2.0 g |
| Triethanolamine | 8.0 g | 12.0 g |
| Sodium chloraide | 1.4 g | — |
| Potassium carbonate | 25 g | 25 g |
| N-ethyl-N-(β-methanesulfonamidoethyl)-3-methyl-4-aminoaniline sulfate | 5.5 g | 7.0 g |
| N,N-biscarboxymethylhydrazine (III-19) | 5.5 g | 7.0 g |
| Fluorescent brightener (WHITEX 4, mfd. by Sumitomo Chemical Co., Ltd.) | 1.0 g | 2.0 g |
| Solvent for silver halide | (see TABLE 11) | |
| Water | ad 1000 ml | 1000 ml |
| pH (25° C.) | 10.05 | 10.45 |
| Rinsing solution | | |
| Ion-exchanged water (having calcium and magnesium content of 3 ppm or less) | | |

The photographic properties ($D_{min}$ and $D_{max}$) of the thus processed Sample and the clarity of the color image were examined. The results are shown in Table 11.

It is apparent from the results shown in Table 11 that when the photosensitive material comprising the emulsion having a high siler chloride content and the coupler having a DCP of at least 0.75 was subjected to the color development/fixing with the automatic developing machine as in this Example, a high maximum density ($D_{max}$) and a low minimum density ($D_{min}$) were obtained and the formed color image had a high color clarity. This effect is evident when it is compared with those obtained by Process Nos. 11, 14 and 19 in Example 6. (See Table 7).

TABLE 11

| Process No. | Solvent for silver halide* [$2.0 \times 10^{-2}$ mol/l] (Mother liquor) | BL Photographic properties $D_{min}$ | BL Photographic properties $D_{max}$ | BL $D_B = 1.0$ $D_G$ | BL $D_B = 1.0$ $D_R$ | GL Photographic properties $D_{min}$ | GL Photographic properties $D_{max}$ | GL $D_G = 1.0$ $D_B$ | GL $D_G = 1.0$ $D_R$ | RL Photographic properties $D_{min}$ | RL Photographic properties $D_{max}$ | RL $D_R = 1.0$ $D_B$ | RL $D_R = 1.0$ $D_G$ |
|---|---|---|---|---|---|---|---|---|---|---|---|---|---|
| 23 | — | 0.38 | 2.22 | 0.36 | 0.23 | 0.35 | 2.38 | 0.49 | 0.31 | 0.37 | 2.51 | 0.61 | 0.63 |
| 24 | Solvent for silver halide (1) | 0.22 | 2.10 | 0.28 | 0.17 | 0.18 | 2.29 | 0.30 | 0.22 | 0.20 | 2.38 | 0.40 | 0.41 |
| 25 | Solvent for silver halide (2) | 0.23 | 2.11 | 0.29 | 0.18 | 0.19 | 2.29 | 0.30 | 0.22 | 0.21 | 2.38 | 0.41 | 0.42 |

*Solvent (1) for silver halide Sodium thiosulfate
solvent (2) for silver halide $HOCH_2CH_2SCH_2CH_2SCH_2CH_2OH$
The replenisher had a concentration of $2.8 \times 10^{-2}$ mol/l.

Furthermore, process No. 26 was conducted by the same method of process No. 24, except that a mixture 1:1 of molar ratio of the solvent (1) to the solvent (2) was used in the same concentration of the solvent (1) of process No. 24, and therefore, the same results as those of process No. 24 were obtained. As shown by the results, there can be obtained good results by the continuous processing with a mixture of the solvents for silver halide.

EXAMPLE 11

A support comprising a polyethylene terephthalate resin film containing titanium oxide ($TiO_2$) as white pigment and having a primer coat formed thereon was used. A multi-layer color photographic paper was prepared by forming the same layers as those of Example 6 in the same manner as that of the preparation of Sample 701.

The sample was exposed and processed in the same manner as that of Example 10 and the photographic properties and stain of the formed color image were examined to obtain results the same as those shown in Table 11. The color image obtained by using the support of this Example had excellent gloss and smoothness and, therefore, an excellent saturation. In particular, an image printed through a color negative was an excellent color image having excellent saturation and detail at the dark parts. This effect was remarkable when the color development/fixing solution containing the solvent for the silver halide was used as compared with the case free from the solvent for the silver halide.

EXAMPLE 12

Sample 701 prepared in Example 6 was exposed under the same conditions as those of Example 6. It was then processed with the same color development/fixing solution as that of Example 1 except that N-ethyl-N-(β-methanesulfonamidoethyl)-3-methyl-4-aminoaniline sulfate used as the color developing agent was replaced with an equimolar amount of N-ethyl-N-β-hydroxyethyl-3-methyl-4-aminoaniline sulfate, or a mixture of 1:1 molar ratio of N-ethyl-N-(β-methanesulfonamidoethyl)-3-methyl-4-aminoaniline sulfate to N-ethyl-N-β-hydroxyethyl-3-methyl-4-aminoaniline sulfate used as the color developing agent was replaced with an equimolar amount of N-ethyl-N-β-hydroxyethyl-3-methyl-4-aminoaniline sulfate and that the same compound in the same concentration as in Table 7 in Example 6 was used as the solvent for the silver halide.

The photographic properties ($D_{min}$ and $D_{max}$) and color clarity thus obtained were similar to those shown in Table 7. It was confirmed that the preferred concentration of the solvent for the silver halide ranges 0.01 to 0.1 mol/l.

EXAMPLE 13

Sample 701 prepared in Example 6 was exposed under the same conditions as those of Example 6. It was then processed with the same color development/fixing solution as that of Example 1 except that N-ethyl-N(β-methanesulfonamidoethyl)-3-methyl-4-aminoaniline sulfate and diethyl hydroxylamine were replaced with an equimolar amount of N-ethyl-N-(γ-hydroxypropyl)-3-methyl-4-aminoaniline sulfate and disulfopropyl hydroxylamine, respectively, and that $5\times10^{-2}$ mol/l of potassium thiocyanate was used as the solvent for the silver halide, and that the time period for the development/fixing was changed to 30 seconds from 45 seconds.

The photographic properties were determined similarly to Example 6 and as a result, the photographic properties ($D_{min}$ and $D_{max}$) were found to be similar to those shown in Table 7.

When a combination of a yellow, magenta or cyan coupler having a high dye covering power with an emulsion having a high silver chloride content, particularly silver chlorobromide or silver chloroiodobromide emulsion having a silver chloride content of at least 90 molar %, is used, a high maximum density, a low minimum density and a high color clarity of the color image can be obtained by the processing steps of: color development/fixing.—washing with water and/or stabilization—drying. Thus the process can be conducted easily and rapidly. A simple, small-sized processing apparatus can be used.

What is claimed is:

1. A process for forming a color image comprising developing an image-wise exposed color photographic material which comprises a support having at least one layer containing a coupler capable of forming a dye by reaction with an oxidized aromatic primary amino color developing agent and having a dye covering power of at least 0.75, and a silver chlorobromide emulsion or silver chloroiodobromide emulsion containing at least 90 molar % of silver chloride with a processing solution containing a solvent for the silver halide in the presence of an aromatic primary amino color developing agent so as to conduct the development and desilverization in one step.

2. A process for forming a color image as set forth in claim 1 wherein the coupler is at least one diequivalent coupler represented by the following general formula (1):

$$\text{Cp-X} \qquad (1)$$

wherein Cp represents a mother nucleus of the coupler and X represents a coupling-off group

3. A process for forming a color image as set forth in claim 2 wherein the coupler is selected from the group consisting of acyl acetamide yellow couplers.

4. A process for forming a color image as set forth in claim 3 wherein the coupler is selected from the group consisting of yellow couplers represented by the following general formulae [Y-1] and [Y-2]:

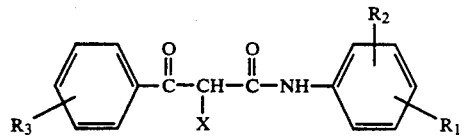

(Y-1)

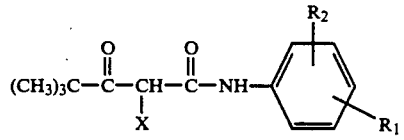

(Y-2)

wherein X represents a coupling-off group, $R_1$ represents a diffusion-resistant group having a total carbon number of 8 to 32, $R_2$ represents a hydrogen atom, one or more halogen atoms, lower alkyl group, lower alkoxy group or diffusion-resistant group having a total carbon number of 8 to 32, $R_3$ represents a hydrogen atom or a substituent and when two or more $R_3$ groups are present, they may be either the same or different from one another.

5. A process for forming a color image as set forth in claim 2 wherein the coupler is selected from the group consisting of oil-protected indazolone, cyanoacetyl, pyrazolone and pyrazoloazole magenta couplers.

6. A process for forming a color image as set forth in claim 5 wherein the coupler is selected from the group consisting of magenta couplers represented by the following general formulae [M-1] to [M-3]:

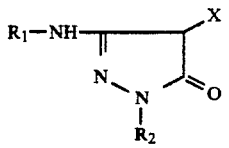
(M-1)

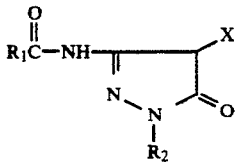
(M-2)

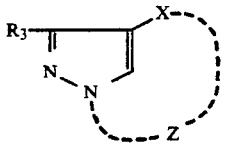
(M-3)

wherein $R_1$ represents a diffusion-resistant group having 8 to 32 carbon atoms in total, $R_2$ represents a phenyl group or substituted phenyl group, $R_3$ represents a hydrogen atom or substituent, Z represents a non-metallic atomic group necessary for forming a five-membered azole ring having 2 to 4 nitrogen atoms which azole ring may have a substituent (including a condensed ring), X represents a splitting-off group.

7. A process for forming a color image as set forth in claim 2 wherein the coupler is selected from the group consisting of phenolic cyan couplers and naphtholic cyan couplers.

8. A process for forming a color image as set forth in claim 1 wherein the content of silver chloride is 90 to 99.9%.

9. A process for forming a color image as set forth in claim 1 wherein the color photographic materials are subjected to color development/fixing, washing with water and/or stabilization, and drying.

10. A process for forming a color image as set forth in claim 9 wherein the color development/fixing is conducted in a single step in which the color photographic materials are developed and fixed with the processing solution containing an aromatic primary amino color developing agent and the solvent for the silver halide.

11. A process for forming a color image as set forth in claim 10 wherein an amount of the developing agent contained in the solution is 0.005 to 0.05 mol per liter of the solution.

12. A process for forming a color image as set forth in claim 1 wherein the processing solution has a pH of 9 to 13.

13. A process for forming a color image as set forth in claim 1 wherein the solvent for the silver halide is selected from the group consisting of alkali metal thiosulfates, alkali metal sulfites, alkali metal thiocyanates, thiourea and its derivatives, mercapto compounds and thioether compounds.

14. A process for forming a color image as set forth in claim 1 wherein the processing solution contains the solvent for the silver halide in an amount of 0.001 to 1 mol/l.

15. A process for forming a color image comprising color developing/fixing an image-wise exposed color photographic material comprising a support having at least one layer containing a coupler capable of forming a dye by reaction with an oxidized aromatic primary amino color developing agent and having a dye covering power of at least 0.75, a silver chlorobromide emulsion or silver chloroiodobromide emulsion containing at least 90 molar % of silver chloride, and an aromatic primary amino color developing agent with a processing solution containing a solvent for the silver halide in the presence of an aromatic primary amino color developing agent so as to conduct the development and desilverization in one step, washing with water and/or stabilization, and drying.

16. A process for forming a color image as set forth in claim 15 wherein an amount of the developing agent contained in the color photographic materials is 0.1 to 10 mol per mol of total silver content of the photographic material per a unit area.

* * * * *